US010968537B2

(12) United States Patent
Sivik et al.

(10) Patent No.: US 10,968,537 B2
(45) **Date of Patent: *Apr. 6, 2021**

(54) FIBROUS ELEMENTS COMPRISING POLYETHYLENE OXIDE

(71) Applicant: The Procter & Gamble Company, Cincinnati, OH (US)

(72) Inventors: Mark Robert Sivik, Mason, OH (US); Mark William Hamersky, Hamilton, OH (US); Paul R. Mort, III, Cincinnati, OH (US); Jose Manuel Montenegro-Alvarado, Hamilton, OH (US); Seth Edward Lindberg, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/413,979

(22) Filed: May 16, 2019

(65) Prior Publication Data

US 2019/0271099 A1 Sep. 5, 2019

Related U.S. Application Data

(63) Continuation of application No. 15/408,451, filed on Jan. 18, 2017, now Pat. No. 10,294,586.

(60) Provisional application No. 62/281,406, filed on Jan. 21, 2016.

(51) Int. Cl.

| | |
|---|---|
| ***C11D 3/37*** | (2006.01) |
| ***D01F 6/66*** | (2006.01) |
| ***D01F 1/10*** | (2006.01) |
| ***C11D 1/14*** | (2006.01) |
| ***C11D 1/22*** | (2006.01) |
| ***C11D 17/04*** | (2006.01) |
| ***D01F 6/34*** | (2006.01) |
| *D01F 6/14* | (2006.01) |

(52) U.S. Cl.

CPC ..... *D01F 6/66* (2013.01); *C11D 1/146* (2013.01); *C11D 1/22* (2013.01); *C11D 3/3707* (2013.01); *C11D 3/3761* (2013.01); *C11D 17/041* (2013.01); *D01F 1/10* (2013.01); *D01F 6/34* (2013.01); *D01F 6/14* (2013.01)

(58) Field of Classification Search

CPC ..... C11D 17/041; D01F 6/66
USPC ..... 510/438; 424/70.11
See application file for complete search history.

(56) References Cited

U.S. PATENT DOCUMENTS

| | | | | |
|---|---|---|---|---|
| 10,294,586 | B2 * | 5/2019 | Sivik | C11D 1/146 |
| 2012/0052037 | A1 * | 3/2012 | Sivik | A61K 8/0216 424/70.11 |

(Continued)

FOREIGN PATENT DOCUMENTS

| | | |
|---|---|---|
| GB | 1 285 584 | 8/1972 |
| JP | S55 71814 A | 11/1998 |
| KR | 930 003 221 | 4/1993 |

OTHER PUBLICATIONS

PCT International Search Report dated Apr. 3, 2017—5 pages.
All Office Actions U.S. Appl. No. 15/408,451.

*Primary Examiner* — Gregory E Webb
(74) *Attorney, Agent, or Firm* — C. Brant Cook

(57) ABSTRACT

Fibrous elements containing one or more fibrous element-forming materials and one or more polyethylene oxides, and methods for making same are provided.

25 Claims, 2 Drawing Sheets

(56) References Cited

U.S. PATENT DOCUMENTS

2015/0297494 A1* 10/2015 Mao ..... A61Q 5/02
424/401
2017/0211207 A1* 7/2017 Sivik ..... D01F 6/34

* cited by examiner

FIBROUS ELEMENTS COMPRISING POLYETHYLENE OXIDE

FIELD OF THE INVENTION

The present invention relates to fibrous elements, and more particularly to fibrous elements comprising one or more fibrous element-forming materials and one or more polyethylene oxides (PEO), and methods for making same.

BACKGROUND OF THE INVENTION

Fibrous elements comprising one or more fibrous element-forming materials, such as carboxymethyl cellulose, starch, and polyvinyl alcohol, and a high (at least 500,000 g/mol) weight average molecular weight polymer, such as polyacrylamide, are known in the art.

One such fibrous element comprises carboxymethyl cellulose as the fibrous element-forming material and a polyacrylamide that exhibits a weight average molecular weight of at least 500,000 g/mol as measured according to the Weight Average Molecular Weight Test Method described herein exhibits cleaning negatives as measured according to the Cleaning Test Method described herein. It was found that the polyacrylamide was the culprit for the cleaning negatives.

As a result, formulators produced a fibrous element comprising two fibrous element-forming materials; namely, Celvol 420H polyvinyl alcohol (PVOH 420H) (Mw 85,000-125,000 g/mol, 78-82% hydrolyzed, available from Kuraray America, Inc.) and Celvol 505 polyvinyl alcohol (PVOH 505) (Mw 40,000-50,000 g/mol, 72-75% hydrolyzed, available from Kuraray America, Inc.). It was found that this formulation, in particular, the Celvol 420H polyvinyl alcohol, also exhibited cleaning negatives as measured according to the Cleaning Test Method described herein.

In light of the foregoing, the problem to be addressed by formulators is how to formulate a fibrous element, especially a fibrous element, such as a filament, that comprises one or more fibrous element-forming materials, that mitigates or eliminates the cleaning negatives seen in prior fibrous element formulations.

Accordingly, there is a need for a fibrous element comprising one or more fibrous element-forming materials wherein the fibrous element exhibits improved cleaning compared to known fibrous elements as measured according to the Cleaning Test Method described herein, and methods for making such fibrous elements and compositions used therein.

SUMMARY OF THE INVENTION

The present invention fulfills the need described above by providing a fibrous element comprising one or more fibrous element-forming materials and a polyethylene oxide that exhibits improved cleaning compared to known fibrous elements as measured according to the Cleaning Test Method described herein.

One solution to the problem identified above is to provide a fibrous element comprising one or more fibrous element-forming materials and a polyethylene oxide that exhibits a weight average molecular weight of less than 500,000 g/mol, such as less than 300,000 g/mol and/or greater than 200 and/or greater than 1,000 and/or greater than 4,000 and/or greater than 8,000 g/mol and/or greater than 10,000 g/mol but less than 500,000 g/mol as measured according to the Weight Average Molecular Weight Test Method described herein such that the fibrous element exhibits improved cleaning compared to such known fibrous elements without the polyethylene oxide as measured according to the Cleaning Test described herein.

It has unexpectedly been found that the inclusion of polyethylene oxide having a weight average molecular weight of greater than 10,000 g/mol but less than 500,000 g/mol provides novel cleaning benefits to fibrous elements comprising one or more fibrous element-forming materials and fibrous structures comprising such fibrous elements as measured according to the Cleaning Test Method described herein.

Commercially available polyethylene oxides are available in a range of weight average molecular weights. For example, very low weight average molecular weight polyethylene oxides (10,000 g/mol and less, such as 8,000 g/mol, 4,000 g/mol, 2,000 g/mol, 1,000 g/mol, and even 600, 400, and 200 g/mol) are available as liquids. Further, polyethylene oxides that exhibit medium weight average molecular weights (100,000 g/mol to less than 500,000 g/mol) are commercially available. Lastly, high weight average molecular weight (500,000 g/mol and more, such as 1,000,000 g/mol, 2,000,000 g/mol, 4,000,000 g/mol, 8,000,000 g/mol, 10,000,000 g/mol, 15,000,000 g/mol, and 25,000,000 g/mol) polyethylene oxides are available as waxy, solids.

In one example of the present invention, a fibrous element, for example a filament and/or fiber, comprising one or more fibrous element-forming materials and a first polyethylene oxide, wherein the first polyethylene oxide exhibits a weight average molecular weight of greater than 10,000 g/mol but less than 500,000 g/mol as measured according to the Weight Average Molecular Weight Test Method, is provided.

In another example of the present invention, a method for making a fibrous element, for example a fibrous element according to the present invention, the method comprising the steps of spinning a composition comprising a one or more fibrous element-forming materials and a first polyethylene oxide, wherein the first polyethylene oxide exhibits a weight average molecular weight of greater than 10,000 g/mol but less than 500,000 g/mol as measured according to the Weight Average Molecular Weight Test Method such that a fibrous element is formed, is provided.

In another example of the present invention, a fibrous structure comprising a plurality of fibrous elements according to the present invention, is provided.

In still another example of the present invention, a composition, for example a fibrous element-forming composition, such as a filament-forming composition, suitable for producing fibrous elements of the present invention, for example by a spinning process, comprising a one or more fibrous element-forming materials and a first polyethylene oxide, and optionally one or more polar solvents, such as water, and optionally one or more active agents, such as a surfactant, wherein the first polyethylene oxide exhibits a weight average molecular weight of greater than 10,000 g/mol but less than 500,000 g/mol as measured according to the Weight Average Molecular Weight Test Method, is provided.

In even another example of the present invention, a fibrous element, for example a filament and/or fiber, comprising one or more fibrous element-forming materials and a first polyethylene oxide, wherein the first polyethylene oxide exhibits a weight average molecular weight of greater than 200 g/mol and/or greater than 1,000 g/mol and/or greater than 4,000 g/mol and/or greater than 8,000 g/mol but less than 500,000 g/mol as measured according to the Weight Average Molecular Weight Test Method, is provided.

In another example of the present invention, a method for making a fibrous element, for example a fibrous element according to the present invention, the method comprising the steps of spinning a composition comprising a one or more fibrous element-forming materials and a first polyethylene oxide, wherein the first polyethylene oxide exhibits a weight average molecular weight of greater than 200 g/mol and/or greater than 1,000 g/mol and/or greater than 4,000 g/mol and/or greater than 8,000 g/mol but less than 500,000 g/mol as measured according to the Weight Average Molecular Weight Test Method such that a fibrous element is formed, is provided.

In still another example of the present invention, a composition, for example a fibrous element-forming composition, such as a filament-forming composition, suitable for producing fibrous elements of the present invention, for example by a spinning process, comprising a one or more fibrous element-forming materials and a first polyethylene oxide, and optionally one or more polar solvents, such as water, and optionally one or more active agents, such as a surfactant, wherein the first polyethylene oxide exhibits a weight average molecular weight of greater than 200 g/mol and/or greater than 1,000 g/mol and/or greater than 4,000 g/mol and/or greater than 8,000 g/mol but less than 500,000 g/mol as measured according to the Weight Average Molecular Weight Test Method, is provided.

In even another example of the present invention, a polyethylene oxide that exhibits a weight average molecular weight of greater than 10,000 g/mol to less than 100,000 g/mol. as measured according to the Weight Average Molecular Weight Test Method, is provided.

In yet another example of the present invention, a composition comprising a surfactant and a first polyethylene oxide wherein the viscosity of the composition is less than the viscosity of the composition void of the first polyethylene oxide as measured according to the Shear Viscosity Test Method described herein, is provided.

In even yet another example of the present invention, a method for making a fibrous element, for example a filament and/or fiber, the method comprising the steps of:

a. providing a fibrous element-forming composition comprising one or more fibrous element-forming materials, a polyethylene oxide that exhibits a weight average molecular weight of greater than 200 g/mol and/or greater than 1,000 g/mol and/or greater than 4,000 g/mol and/or greater than 8,000 g/mol and/or greater than 10,000 g/mol but less than 500,000 g/mol as measured according to the Weight Average Molecular Weight Test Method, and optionally one or more active agents, such as a surfactant, and optionally, one or more polar solvents (such as water); and b. spinning the fibrous element-forming composition into one or more fibrous elements, for example filaments and/or fibers, comprising the one or more fibrous element-forming materials, the polyethylene oxide, and optionally the one or more active agents, for example that are releasable and/or released from the fibrous element when exposed to conditions of intended use of the fibrous element, is provided. In one example, the total level of the fibrous element-forming materials present in the fibrous element is 80% or less and/or 70% or less and/or 60% or less and/or 50% or less and/or 40% or less and/or 30% or less and/or 20% or less by weight on a dry fibrous element basis and the total level of the active agents present in the fibrous element is 20% or greater and/or 30% or greater and/or 40% or greater 50% or greater and/or 60% or greater and/or 70% or greater and/or 80% or greater by weight on a dry fibrous element basis.

In yet another example of the present invention, a method for making a fibrous structure, the method comprising the steps of:

a. providing a fibrous element-forming composition comprising one or more fibrous element-forming materials, a polyethylene oxide that exhibits a weight average molecular weight of greater than 200 g/mol and/or greater than 1,000 g/mol and/or greater than 4,000 g/mol and/or greater than 8,000 g/mol and/or greater than 10,000 g/mol but less than 500,000 g/mol as measured according to the Weight Average Molecular Weight Test Method, and optionally one or more active agents, such as a surfactant, and optionally, one or more polar solvents (such as water);

b. spinning the fibrous element-forming composition into one or more fibrous elements, for example filaments and/or fibers, comprising the one or more fibrous element-forming materials, the polyethylene oxide, and optionally the one or more active agents, for example that are releasable and/or released from the fibrous element when exposed to conditions of intended use of the fibrous element; and c. collecting a plurality of the fibrous elements on a collection device, such as a belt or fabric, such that the fibrous elements are inter-entangled to form a fibrous structure, is provided.

In yet another example of the present invention, a method for making a fibrous structure, the method comprising the steps of:

a. providing a fibrous element-forming composition comprising one or more fibrous element-forming materials, a polyethylene oxide that exhibits a weight average molecular weight of greater than 200 g/mol and/or greater than 1,000 g/mol and/or greater than 4,000 g/mol and/or greater than 8,000 g/mol and/or greater than 10,000 g/mol but less than 500,000 g/mol as measured according to the Weight Average Molecular Weight Test Method, and optionally one or more active agents, such as a surfactant, and optionally, one or more polar solvents (such as water);

b. spinning the fibrous element-forming composition into one or more fibrous elements, for example filaments and/or fibers, comprising the one or more fibrous element-forming materials, the polyethylene oxide, and optionally the one or more active agents, for example that are releasable and/or released from the fibrous element when exposed to conditions of intended use of the fibrous element;

c. combining a plurality of particles comprising one or more active agents with a plurality of the fibrous elements to form a mixture; and d. collecting the mixture on a collection device, such as a belt or fabric, such that the fibrous elements are inter-entangled with the particles to form a fibrous structure, is provided.

In even still yet another example of the present invention, a product, for example a laundry detergent product and/or a dishwashing detergent product and/or a hard surface cleaning product and/or a hair care product comprising one or more fibrous elements and/or one or more fibrous structures of the present invention is provided. In one example, in addition to the fibrous elements and/or fibrous structures, the product may comprise a film.

Even though the examples provided herein refer to fibrous elements, for example filaments and/or fibers made from the filaments of the present invention, such as by cutting a filament into fibers, the fibrous structures of the present invention may comprise a mixture of fibrous elements, such as a mixture of both filaments and fibers.

Accordingly, the present invention provides fibrous elements, for example filaments and/or fibers, and/or fibrous structures comprising fibrous elements and/or products comprising such fibrous elements and/or fibrous structures comprising one or more fibrous element-forming materials and a polyethylene oxide that exhibits a weight average molecular weight of greater than 200 g/mol and/or greater than 1,000 g/mol and/or greater than 4,000 g/mol and/or greater than 8,000 g/mol and/or greater than 10,000 g/mol but less than 500,000 g/mol as measured according to the Weight Average Molecular Weight Test Method and methods for making same.

DETAILED DESCRIPTION OF THE INVENTION

Definitions

Figure 1:
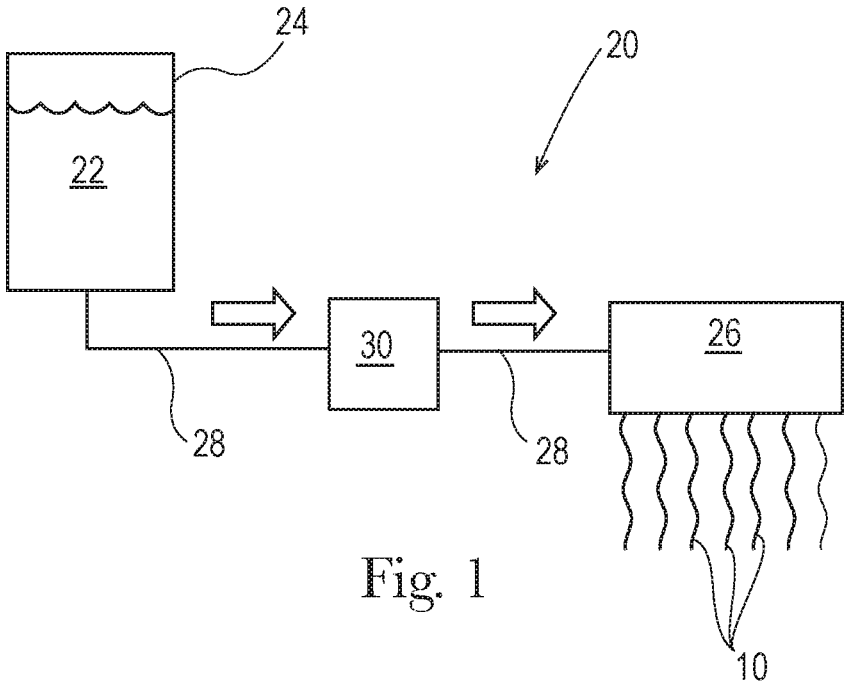
FIG. 1 is a schematic representation of an example of a process for making fibrous elements of the present invention.

"Fibrous structure" as used herein means a structure that comprises one or more fibrous elements. In one example, a fibrous structure according to the present invention means an association of fibrous elements and particles that together form a structure, such as a unitary structure, capable of performing a function.

The fibrous structures of the present invention may be homogeneous or may be layered. If layered, the fibrous structures may comprise at least two and/or at least three and/or at least four and/or at least five layers, for example one or more fibrous element layers, one or more particle layers and/or one or more fibrous element/particle mixture layers. In one example, in a multiple layer fibrous structure, one or more layers may be formed and/or deposited directly upon an existing layer to form a fibrous structure whereas in a multi-ply fibrous structure, one or more existing fibrous structure plies may be combined, for example via thermal bonding, gluing, embossing, rodding, rotary knife aperturing, needlepunching, knurling, tufting, and/or other mechanical combining process, with one or more other existing fibrous structure plies to form the multi-ply fibrous structure.

In one example, the fibrous structure is a multi-ply fibrous structure that exhibits a basis weight of less than 10000 g/m$^2$ and/or less than 7500 g/m$^2$ and/or less than 5000 g/m$^2$ and/or less than 3000 g/m$^2$ and/or greater than 50 g/m$^2$ and/or greater than 100 g/m$^2$ and/or greater than 250 g/m$^2$ and/or greater than 500 g/m$^2$ as measured according to the Basis Weight Test Method described herein.

In one example, the fibrous structure is a sheet of fibrous elements (fibers and/or filaments, such as continuous filaments), of any nature or origin, that have been formed into a fibrous structure by any means, and may be bonded together by any means, with the exception of weaving or knitting. Felts obtained by wet milling are not fibrous structures or soluble fibrous structures within the scope of the present invention. In one example, a fibrous structure according to the present invention means an orderly arrangement of filaments within a structure in order to perform a function. In another example, a fibrous structure of the present invention is an arrangement comprising a plurality of two or more and/or three or more fibrous elements that are inter-entangled or otherwise associated with one another to form a fibrous structure. In yet another example, the fibrous structure of the present invention may comprise, in addition to the fibrous elements of the present invention, one or more solid additives, such as particulates and/or fibers.

In one example of the present invention, the fibrous structure of the present invention comprises one or more fibrous elements, for example filaments and/or fibers, wherein the fibrous structure comprises one or more active agents, such as in the form of a liquid and/or a solid for example a particle, within one or more fibrous elements and/or on a surface of one or more fibrous elements and/or within the fibrous structure such as between fibrous elements, for example within the interstices of the fibrous structure and/or between two or more fibrous structures that are attached directly or indirectly to one another and/or between two or more layers of fibrous elements that form the fibrous structure and/or on a surface of the fibrous structure and/or on surface of one or more of the fibrous elements, and one or more deterrent agents, for example within one or more fibrous elements and/or on a surface of one or more fibrous elements and/or within the fibrous structure such as between fibrous elements, for example within the interstices of the fibrous structure and/or between two or more fibrous structures that are attached directly or indirectly to one another and/or between two or more layers of fibrous elements that form the fibrous structure and/or on a surface of the fibrous structure and/or on surface of one or more of the fibrous elements.

In another example, a fibrous structure of the present invention may comprise one or more active agents that are present within the fibrous structure when originally made, but then bloom to a surface of the fibrous structure prior to and/or when exposed to conditions of intended use of the fibrous structure.

In addition to or alternatively, a fibrous structure of the present invention may comprise one or more active agents that are present within the fibrous structure when originally made, but then bloom to a surface of the fibrous structure prior to and/or when exposed to conditions of intended use of the fibrous structure.

The fibrous structure and/or product comprising the fibrous structure may be of a shape and size, for example suitable for dosing in a washing machine and/or dishwashing machine, and comprise a total level (by weight) of active agents such that greater than 1 g and/or greater than 3 g and/or greater than 5 g and/or greater than 8 g and/or greater than 10 g of active agents are delivered during use of the fibrous structure and/or product, such as during washing of clothes in a washing machine and/or sink basin and/or washing of dishes in a dishwashing machine.

In one example, the fibrous structure of the present invention is a "unitary fibrous structure."

"Unitary fibrous structure" as used herein is an arrangement comprising a plurality of two or more and/or three or more fibrous elements that are inter-entangled or otherwise associated with one another to form a fibrous structure. A unitary fibrous structure of the present invention may be one or more plies within a multi-ply fibrous structure. In one example, a unitary fibrous structure of the present invention may comprise three or more different fibrous elements. In another example, a unitary fibrous structure of the present invention may comprise two different fibrous elements, for example a conformed fibrous structure, upon which a different fibrous elements are deposited to form a fibrous structure comprising three or more different fibrous elements. In one example, a fibrous structure may comprise soluble, for example water-soluble, fibrous elements and insoluble, for example water insoluble fibrous elements.

"Coformed fibrous structure" as used herein means that the fibrous structure comprises a mixture of at least two different materials wherein at least one of the materials comprises a fibrous element and at least one other material comprises a particle, for example a particle comprising an active agent and/or a deterrent agent.

"Soluble fibrous structure" as used herein means the fibrous structure and/or components thereof, for example greater than 0.5% and/or greater than 1% and/or greater than 5% and/or greater than 10% and/or greater than 25% and/or greater than 50% and/or greater than 75% and/or greater than 90% and/or greater than 95% and/or about 100% by weight of the fibrous structure is soluble, for example polar solvent-soluble such as water-soluble. In one example, the soluble fibrous structure comprises fibrous elements wherein at least 50% and/or greater than 75% and/or greater than 90% and/or greater than 95% and/or about 100% by weight of the fibrous elements within the soluble fibrous structure are soluble.

The soluble fibrous structure comprises a plurality of fibrous elements. In one example, the soluble fibrous structure comprises two or more and/or three or more different fibrous elements.

The soluble fibrous structure and/or fibrous elements thereof, for example filaments, making up the soluble fibrous structure may comprise one or more active agents, for example a fabric care active agent, a dishwashing active agent, a hard surface active agent, a hair care active agent, a floor care active agent, a skin care active agent, an oral care active agent, a medicinal active agent, and mixtures thereof. In one example, a soluble fibrous structure and/or fibrous elements thereof of the present invention comprises one or more surfactants, one or more enzymes (such as in the form of an enzyme prill), one or more perfumes and/or one or more suds suppressors. In another example, a soluble fibrous structure and/or fibrous elements thereof of the present invention comprises a builder and/or a chelating agent. In another example, a soluble fibrous structure and/or fibrous elements thereof of the present invention comprises a bleaching agent (such as an encapsulated bleaching agent). In still another example, a soluble fibrous structure and/or fibrous elements thereof of the present invention comprises one or more surfactants and optionally, one or more perfumes.

In one example, the soluble fibrous structure of the present invention is a water-soluble fibrous structure.

In one example, the soluble fibrous structure of the present invention exhibits a basis weight of less than 10000 $g/m^2$ and/or less than 5000 $g/m^2$ and/or less than 4000 $g/m^2$ and/or less than 2000 $g/m^2$ and/or less than 1000 $g/m^2$ and/or less than 500 $g/m^2$ and/or greater than 10 $g/m^2$ and/or greater than 25 $g/m^2$ and/or greater than 50 $g/m^2$ and/or greater than 100 $g/m^2$ and/or greater than 250 $g/m^2$ as measured according to the Basis Weight Test Method described herein.

"Fibrous element" as used herein means an elongate particulate having a length greatly exceeding its average diameter, i.e. a length to average diameter ratio of at least about 10. A fibrous element may be a filament or a fiber. In one example, the fibrous element is a single fibrous element or a yarn comprising a plurality of fibrous elements. In another example, the fibrous element is a single fibrous element.

The fibrous elements of the present invention may be spun from a fibrous element-forming compositions also referred to as fibrous element-forming compositions via suitable spinning process operations, such as meltblowing, spunbonding, electro-spinning, and/or rotary spinning.

The fibrous elements of the present invention may be monocomponent and/or multicomponent. For example, the fibrous elements may comprise bicomponent fibers and/or filaments. The bicomponent fibers and/or filaments may be in any form, such as side-by-side, core and sheath, islands-in-the-sea and the like.

In one example, the fibrous element, which may be a filament and/or a fiber and/or a filament that has been cut to smaller fragments (fibers) of the filament may exhibit a length of greater than or equal to 0.254 cm (0.1 in.) and/or greater than or equal to 1.27 cm (0.5 in.) and/or greater than or equal to 2.54 cm (1.0 in.) and/or greater than or equal to 5.08 cm (2 in.) and/or greater than or equal to 7.62 cm (3 in.) and/or greater than or equal to 10.16 cm (4 in.) and/or greater than or equal to 15.24 cm (6 in.). In one example, a fiber of the present invention exhibits a length of less than 5.08 cm (2 in.).

"Filament" as used herein means an elongate particulate as described above. In one example, a filament exhibits a length of greater than or equal to 5.08 cm (2 in.) and/or greater than or equal to 7.62 cm (3 in.) and/or greater than or equal to 10.16 cm (4 in.) and/or greater than or equal to 15.24 cm (6 in.).

Filaments are typically considered continuous or substantially continuous in nature. Filaments are relatively longer than fibers. Filaments are relatively longer than fibers. Non-limiting examples of filaments include meltblown and/or spunbond filaments.

In one example, one or more fibers may be formed from a filament of the present invention, such as when the filaments are cut to shorter lengths. Thus, in one example, the present invention also includes a fiber made from a filament of the present invention, such as a fiber comprising one or more fibrous element-forming materials and one or more additives, such as active agents. Therefore, references to filament and/or filaments of the present invention herein also include fibers made from such filament and/or filaments unless otherwise noted. Fibers are typically considered discontinuous in nature relative to filaments, which are considered continuous in nature.

Non-limiting examples of fibrous elements include meltblown and/or spunbond fibrous elements. Non-limiting examples of polymers that can be spun into fibrous elements include natural polymers, such as starch, starch derivatives, cellulose, such as rayon and/or lyocell, and cellulose derivatives, hemicellulose, hemicellulose derivatives, and synthetic polymers including, but not limited to thermoplastic polymer fibrous elements, such as polyesters, nylons, polyolefins such as polypropylene filaments, polyethylene filaments, and biodegradable thermoplastic fibers such as polylactic acid filaments, polyhydroxyalkanoate filaments, polyesteramide filaments and polycaprolactone filaments. Depending upon the polymer and/or composition from which the fibrous elements are made, the fibrous elements may be soluble or insoluble.

"Fibrous element-forming composition" as used herein means a composition that is suitable for making a fibrous element, for example a filament, of the present invention such as by meltblowing and/or spunbonding. The fibrous element-forming composition comprises one or more fibrous element-forming materials that exhibit properties that make them suitable for spinning into a fibrous element, for example a filament. In one example, the fibrous element-forming material comprises a polymer. In addition to one or more fibrous element-forming materials, the fibrous element-forming composition may comprise one or more additives, for example one or more active agents. In addition, the fibrous element-forming composition may comprise one or more polar solvents, such as water, into which one or more, for example all, of the fibrous element-forming materials and/or one or more, for example all, of the active agents are dissolved and/or dispersed.

In one example, a fibrous element, for example a filament, of the present invention made from a fibrous element-forming composition of the present invention is such that one or more active agents, may be present in the fibrous element, for example filament, rather than on the fibrous element, such as a coating. The total level of fibrous element-forming materials, total level of polyethylene oxides that exhibit a weight average molecular weight of greater than 10,000 g/mol to less than 500,000 g/mol as measured according to the Weight Average Molecular Weight Test Method described herein, total level of polyethylene oxides that exhibit a weight average molecular weight of at least 500,000 g/mol as measure according to the Weight Average Molecular Weight Test Method described herein, and total level of active agents present in the fibrous element-forming composition may be any suitable amount so long as the fibrous elements, for example filaments, of the present invention are produced therefrom. In addition to the active agents being present within the fibrous element, the fibrous element may comprise one or more deterrent agents (not shown) present within and/or on a surface of the fibrous element. Further, in addition to the active agents being present within the fibrous element or alternatively, the fibrous element may comprise one or more active agents on a surface of the fibrous element.

In another example, a fibrous element of the present invention may comprise one or more active agents that are present in the fibrous element when originally made, but then bloom to a surface of the fibrous element prior to and/or when exposed to conditions of intended use of the fibrous element.

"Fibrous element-forming material" as used herein means a material, such as a polymer or monomers capable of producing a polymer that exhibits properties suitable for making a fibrous element. In one example, the fibrous element-forming material comprises one or more substituted polymers such as an anionic, cationic, zwitterionic, and/or nonionic polymer. In another example, the polymer may comprise a hydroxyl polymer, such as a polyvinyl alcohol ("PVOH") and/or a polysaccharide, such as starch and/or a starch derivative, such as an ethoxylated starch and/or acid-thinned starch. In another example, the polymer may comprise polyethylenes and/or terephthalates. In yet another example, the fibrous element-forming material is a polar solvent-soluble material.

"Particle" as used herein means a solid additive, such as a powder, granule, encapsulate, microcapsule, and/or prill. In one example, the fibrous elements and/or fibrous structures of the present invention may comprise one or more particles. The particles may be intra-fibrous element (within the fibrous elements, like the active agents and/or deterrent agents), on a surface of the fibrous element, such as a coating composition, and/or inter-fibrous element (between fibrous elements within a fibrous structure, for example a soluble fibrous structure). Non-limiting examples of fibrous elements and/or fibrous structures comprising particles are described in US 2013/0172226 which is incorporated herein by reference. The shape of the particle can be in the form of spheres, rods, plates, tubes, squares, rectangles, discs, stars, fibers or have regular or irregular random forms.

"Deterrent agent-containing particle" as used herein means a solid additive comprising one or more deterrent agents. In one example, the deterrent agent-containing particle is a deterrent agent in the form of a particle (in other words, the particle comprises 100% deterrent agent(s)).

"Active agent-containing particle" as used herein means a solid additive comprising one or more active agents. In one example, the active agent-containing particle is an active agent in the form of a particle (in other words, the particle comprises 100% active agent(s)).

In one example of the present invention, the fibrous structure comprises a plurality of particles, for example active agent-containing particles, and a plurality of fibrous elements in a weight ratio of particles, for example active agent-containing particles, to fibrous elements of 1:100 or greater and/or 1:50 or greater and/or 1:10 or greater and/or 1:3 or greater and/or 1:2 or greater and/or 1:1 or greater and/or from about 7:1 to about 1:100 and/or from about 7:1 to about 1:50 and/or from about 7:1 to about 1:10 and/or from about 7:1 to about 1:3 and/or from about 6:1 to 1:2 and/or from about 5:1 to about 1:1 and/or from about 4:1 to about 1:1 and/or from about 3:1 to about 1.5:1.

In another example of the present invention, the fibrous structure comprises a plurality of particles, for example active agent-containing particles, and a plurality of fibrous elements in a weight ratio of particles, for example active agent-containing particles, to fibrous elements of from about 7:1 to about 1:1 and/or from about 7:1 to about 1.5:1 and/or from about 7:1 to about 3:1 and/or from about 6:1 to about 3:1.

In yet another example of the present invention, the fibrous structure comprises a plurality of particles, for example active agent-containing particles, and a plurality of fibrous elements in a weight ratio of particles, for example active agent-containing particles, to fibrous elements of from about 1:1 to about 1:100 and/or from about 1:2 to about 1:50 and/or from about 1:3 to about 1:50 and/or from about 1:3 to about 1:10.

In another example, the fibrous structure of the present invention comprises a plurality of particles, for example active agent-containing particles, at a particle basis weight of greater than 1 $g/m^2$ and/or greater than 10 $g/m^2$ and/or greater than 20 $g/m^2$ and/or greater than 30 $g/m^2$ and/or greater than 40 $g/m^2$ and/or from about 1 $g/m^2$ to about 5000 $g/m^2$ and/or to about 3500 $g/m^2$ and/or to about 2000 $g/m^2$ and/or from about 1 $g/m^2$ to about 1000 $g/m^2$ and/or from about 10 $g/m^2$ to about 400 $g/m^2$ and/or from about 20 $g/m^2$ to about 300 $g/m^2$ and/or from about 30 $g/m^2$ to about 200 $g/m^2$ and/or from about 40 $g/m^2$ to about 100 $g/m^2$ as measured by the Basis Weight Test Method described herein.

In another example, the fibrous structure of the present invention comprises a plurality of fibrous elements at a basis weight of greater than 1 $g/m^2$ and/or greater than 10 $g/m^2$ and/or greater than 20 $g/m^2$ and/or greater than 30 $g/m^2$ and/or greater than 40 $g/m^2$ and/or from about 1 $g/m^2$ to about 10000 $g/m^2$ and/or from about 10 $g/m^2$ to about 5000 $g/m^2$ and/or to about 3000 $g/m^2$ and/or to about 2000 $g/m^2$ and/or from about 20 $g/m^2$ to about 2000 $g/m^2$ and/or from about 30 $g/m^2$ to about 1000 $g/m^2$ and/or from about 30 $g/m^2$ to about 500 $g/m^2$ and/or from about 30 $g/m^2$ to about 300 $g/m^2$ and/or from about 40 $g/m^2$ to about 100 $g/m^2$ and/or from about 40 g/m$^2$ to about 80 g/m$^2$ as measured by the Basis Weight Test Method described herein. In one example, the fibrous structure comprises two or more layers wherein fibrous elements are present in at least one of the layers at a basis weight of from about 1 g/m$^2$ to about 500 g/m$^2$.

"Additive" as used herein means any material present in the fibrous element of the present invention that is not a fibrous element-forming material. In one example, an additive comprises an active agent. In yet another example, an additive comprises a deterrent agent. In another example, an additive comprises a processing aid. In still another example, an additive comprises a filler. In one example, an additive comprises any material present in the fibrous element that its absence from the fibrous element would not result in the fibrous element losing its fibrous element structure, in other words, its absence does not result in the fibrous element losing its solid form. In another example, an additive, for example an active agent, comprises a non-polymer material.

In another example, an additive comprises a plasticizer for the fibrous element. Non-limiting examples of suitable plasticizers for the present invention include polyols, copolyols, polycarboxylic acids, polyesters and dimethicone copolyols. Examples of useful polyols include, but are not limited to, glycerin, diglycerin, propylene glycol, ethylene glycol, butylene glycol, pentylene glycol, cyclohexane dimethanol, hexanediol, 2,2,4-trimethylpentane-1,3-diol, polyethylene glycol (200-600), pentaerythritol, sugar alcohols such as sorbitol, manitol, lactitol and other mono- and polyhydric low molecular weight alcohols (e.g., C2-C8 alcohols); mono di- and oligo-saccharides such as fructose, glucose, sucrose, maltose, lactose, high fructose corn syrup solids, and dextrins, and ascorbic acid.

In one example, the plasticizer includes glycerin and/or propylene glycol and/or glycerol derivatives such as propoxylated glycerol. In still another example, the plasticizer is selected from the group consisting of glycerin, ethylene glycol, polyethylene glycol, propylene glycol, glycidol, urea, sorbitol, xylitol, maltitol, sugars, ethylene bisformamide, amino acids, sorbates, and mixtures thereof In another example, an additive comprises a crosslinking agent suitable for crosslinking one or more of the fibrous element-forming materials present in the fibrous elements of the present invention. In one example, the crosslinking agent comprises a crosslinking agent capable of crosslinking hydroxyl polymers together, for example via the hydroxyl polymers hydroxyl moieties. Non-limiting examples of suitable crosslinking agents include imidazolidinones, polycarboxylic acids and mixtures thereof. In one example, the crosslinking agent comprises a urea glyoxal adduct crosslinking agent, for example a dihydroxyimidazolidinone, such as dihydroxyethylene urea ("DHEU"). A crosslinking agent can be present in the fibrous element-forming composition and/or fibrous element of the present invention to control the fibrous element's solubility and/or dissolution in a solvent, such as a polar solvent.

In another example, an additive comprises a rheology modifier, such as a shear modifier and/or an extensional modifier. Non-limiting examples of rheology modifiers include but not limited to polyacrylamide, polyurethanes and polyacrylates that may be used in the fibrous elements of the present invention. Non-limiting examples of rheology modifiers are commercially available from The Dow Chemical Company (Midland, Mich.).

In yet another example, an additive comprises one or more colors and/or dyes that are incorporated into the fibrous elements of the present invention to provide a visual signal when the fibrous elements are exposed to conditions of intended use and/or when an active agent is released from the fibrous elements and/or when the fibrous element's morphology changes.

In still yet another example, an additive comprises one or more release agents and/or lubricants. Non-limiting examples of suitable release agents and/or lubricants include fatty acids, fatty acid salts, fatty alcohols, fatty esters, sulfonated fatty acid esters, fatty amine acetates, fatty amide, silicones, aminosilicones, fluoropolymers, and mixtures thereof. In one example, the release agents and/or lubricants are applied to the fibrous element, in other words, after the fibrous element is formed. In one example, one or more release agents/lubricants are applied to the fibrous element prior to collecting the fibrous elements on a collection device to form a fibrous structure. In another example, one or more release agents/lubricants are applied to a fibrous structure formed from the fibrous elements of the present invention prior to contacting one or more fibrous structures, such as in a stack of fibrous structures. In yet another example, one or more release agents/lubricants are applied to the fibrous element of the present invention and/or fibrous structure comprising the fibrous element prior to the fibrous element and/or fibrous structure contacting a surface, such as a surface of equipment used in a processing system so as to facilitate removal of the fibrous element and/or fibrous structure and/or to avoid layers of fibrous elements and/or fibrous structures of the present invention sticking to one another, even inadvertently. In one example, the release agents/lubricants comprise particulates.

In even still yet another example, an additive comprises one or more anti-blocking and/or detackifying agents. Non-limiting examples of suitable anti-blocking and/or detackifying agents include starches, starch derivatives, crosslinked polyvinylpyrrolidone, crosslinked cellulose, microcrystalline cellulose, silica, metallic oxides, calcium carbonate, talc, mica, and mixtures thereof.

"Conditions of intended use" as used herein means the temperature, physical, chemical, and/or mechanical conditions that a fibrous element of the present invention is exposed to when the fibrous element is used for one or more of its designed purposes. For example, if a fibrous element and/or a fibrous structure comprising a fibrous element are designed to be used in a washing machine for laundry care purposes, the conditions of intended use will include that temperature, chemical, physical and/or mechanical conditions present in a washing machine, including any wash water, during a laundry washing operation. In another example, if a fibrous element and/or a fibrous structure comprising a fibrous element are designed to be used by a human as a shampoo for hair care purposes, the conditions of intended use will include that temperature, chemical, physical and/or mechanical conditions present during the shampooing of the human's hair. Likewise, if a fibrous element and/or fibrous structure comprising a fibrous element is designed to be used in a dishwashing operation, by hand or by a dishwashing machine, the conditions of intended use will include the temperature, chemical, physical and/or mechanical conditions present in a dishwashing water and/or dishwashing machine, during the dishwashing operation.

"Active agent" as used herein means an additive that produces an intended effect in an environment external to a fibrous element and/or fibrous structure comprising the fibrous element of the present, such as when the fibrous element is exposed to conditions of intended use of the fibrous element and/or fibrous structure comprising the fibrous element. In one example, an active agent comprises an additive that treats a surface, such as a hard surface (i.e., kitchen countertops, bath tubs, toilets, toilet bowls, sinks, floors, walls, teeth, cars, windows, mirrors, dishes) and/or a soft surface (i.e., fabric, hair, skin, carpet, crops, plants). In another example, an active agent comprises an additive that creates a chemical reaction (i.e., foaming, fizzing, coloring, warming, cooling, lathering, disinfecting and/or clarifying and/or chlorinating, such as in clarifying water and/or disinfecting water and/or chlorinating water). In yet another example, an active agent comprises an additive that treats an environment (i.e., deodorizes, purifies, perfumes air). In one example, the active agent is formed in situ, such as during the formation of the fibrous element containing the active agent, for example the fibrous element may comprise a water-soluble polymer (e.g., starch) and a surfactant (e.g., anionic surfactant), which may create a polymer complex or coacervate that functions as the active agent used to treat fabric surfaces.

"Treats" as used herein with respect to treating a surface means that the active agent provides a benefit to a surface or environment. Treats includes regulating and/or immediately improving a surface's or environment's appearance, cleanliness, smell, purity and/or feel. In one example treating in reference to treating a keratinous tissue (for example skin and/or hair) surface means regulating and/or immediately improving the keratinous tissue's cosmetic appearance and/or feel. For instance, "regulating skin, hair, or nail (keratinous tissue) condition" includes: thickening of skin, hair, or nails (e.g., building the epidermis and/or dermis and/or sub-dermal [e.g., subcutaneous fat or muscle] layers of the skin, and where applicable the keratinous layers of the nail and hair shaft) to reduce skin, hair, or nail atrophy, increasing the convolution of the dermal-epidermal border (also known as the rete ridges), preventing loss of skin or hair elasticity (loss, damage and/or inactivation of functional skin elastin) such as elastosis, sagging, loss of skin or hair recoil from deformation; melanin or non-melanin change in coloration to the skin, hair, or nails such as under eye circles, blotching (e.g., uneven red coloration due to, e.g., rosacea) (hereinafter referred to as "red blotchiness"), sallowness (pale color), discoloration caused by telangiectasia or spider vessels, and graying hair.

In another example, treating means removing stains and/or odors from fabric articles, such as clothes, towels, linens, and/or hard surfaces, such as countertops and/or dishware including pots and pans.

"Fabric care active agent" as used herein means an active agent that when applied to fabric provides a benefit and/or improvement to the fabric. Non-limiting examples of benefits and/or improvements to fabric include cleaning (for example by surfactants), stain removal, stain reduction, wrinkle reduction, color restoration, static control, wrinkle resistance, permanent press, wear reduction, wear resistance, pill removal, pill resistance, soil removal, soil resistance (including soil release), shape retention, shrinkage reduction, softness, fragrance, anti-bacterial, anti-viral, odor resistance, and odor removal.

"Dishwashing active agent" as used herein means an active agent that when applied to dishware, glassware, pots, pans, utensils, and/or cooking sheets provides a benefit and/or improvement to the dishware, glassware, plastic items, pots, pans and/or cooking sheets. Non-limiting example of benefits and/or improvements to the dishware, glassware, plastic items, pots, pans, utensils, and/or cooking sheets include food and/or soil removal, cleaning (for example by surfactants) stain removal, stain reduction, grease removal, water spot removal and/or water spot prevention, glass and metal care, sanitization, shining, and polishing.

"Hard surface active agent" as used herein means an active agent when applied to floors, countertops, sinks, windows, mirrors, showers, baths, and/or toilets provides a benefit and/or improvement to the floors, countertops, sinks, windows, mirrors, showers, baths, and/or toilets. Non-limiting example of benefits and/or improvements to the floors, countertops, sinks, windows, mirrors, showers, baths, and/or toilets include food and/or soil removal, cleaning (for example by surfactants), stain removal, stain reduction, grease removal, water spot removal and/or water spot prevention, limescale removal, disinfection, shining, polishing, and freshening.

"Beauty benefit active agent," as used herein, refers to an active agent that can deliver one or more beauty benefits.

"Skin care active agent" as used herein, means an active agent that when applied to the skin provides a benefit or improvement to the skin. It is to be understood that skin care active agents are useful not only for application to skin, but also to hair, scalp, nails and other mammalian keratinous tissue.

"Hair care active agent" as used herein, means an active agent that when applied to mammalian hair provides a benefit and/or improvement to the hair. Non-limiting examples of benefits and/or improvements to hair include softness, static control, hair repair, dandruff removal, dandruff resistance, hair coloring, shape retention, hair retention, and hair growth.

"Weight ratio" as used herein means the dry fibrous element, for example filament, basis and/or dry fibrous element-forming material (g or %) on a dry weight basis in the fibrous element, for example filament, to the weight of additive, such as active agent(s) (g or %) on a dry weight basis in the fibrous element, for example filament.

"Hydroxyl polymer" as used herein includes any hydroxyl-containing polymer that can be incorporated into a fibrous element of the present invention, for example as a fibrous element-forming material. In one example, the hydroxyl polymer of the present invention includes greater than 10% and/or greater than 20% and/or greater than 25% by weight hydroxyl moieties.

"Biodegradable" as used herein means, with respect to a material, such as a fibrous element as a whole and/or a polymer within a fibrous element, such as a fibrous element-forming material, that the fibrous element and/or polymer is capable of undergoing and/or does undergo physical, chemical, thermal and/or biological degradation in a municipal solid waste composting facility such that at least 5% and/or at least 7% and/or at least 10% of the original fibrous element and/or polymer is converted into carbon dioxide after 30 days as measured according to the OECD (1992) Guideline for the Testing of Chemicals 301B; Ready Biodegradability—$CO_2$ Evolution (Modified Sturm Test) Test incorporated herein by reference.

"Non-biodegradable" as used herein means, with respect to a material, such as a fibrous element as a whole and/or a polymer within a fibrous element, such as a fibrous element-forming material, that the fibrous element and/or polymer is not capable of undergoing physical, chemical, thermal and/or biological degradation in a municipal solid waste composting facility such that at least 5% of the original fibrous element and/or polymer is converted into carbon dioxide after 30 days as measured according to the OECD (1992) Guideline for the Testing of Chemicals 301B; Ready Biodegradability—$CO_2$ Evolution (Modified Sturm Test) Test incorporated herein by reference.

"Non-thermoplastic" as used herein means, with respect to a material, such as a fibrous element as a whole and/or a polymer within a fibrous element, such as a fibrous element-forming material, that the fibrous element and/or polymer exhibits no melting point and/or softening point, which allows it to flow under pressure, in the absence of a plasticizer, such as water, glycerin, sorbitol, urea and the like.

"Non-thermoplastic, biodegradable fibrous element" as used herein means a fibrous element that exhibits the properties of being biodegradable and non-thermoplastic as defined above.

"Non-thermoplastic, non-biodegradable fibrous element" as used herein means a fibrous element that exhibits the properties of being non-biodegradable and non-thermoplastic as defined above.

"Thermoplastic" as used herein means, with respect to a material, such as a fibrous element as a whole and/or a polymer within a fibrous element, such as a fibrous element-forming material, that the fibrous element and/or polymer exhibits a melting point and/or softening point at a certain temperature, which allows it to flow under pressure, in the absence of a plasticizer "Thermoplastic, biodegradable fibrous element" as used herein means a fibrous element that exhibits the properties of being biodegradable and thermoplastic as defined above.

"Thermoplastic, non-biodegradable fibrous element" as used herein means a fibrous element that exhibits the properties of being non-biodegradable and thermoplastic as defined above.

"Non-cellulose-containing" as used herein means that less than 5% and/or less than 3% and/or less than 1% and/or less than 0.1% and/or 0% by weight of cellulose polymer, cellulose derivative polymer and/or cellulose copolymer is present in fibrous element. In one example, "non-cellulose-containing" means that less than 5% and/or less than 3% and/or less than 1% and/or less than 0.1% and/or 0% by weight of cellulose polymer is present in fibrous element.

"Polar solvent-soluble material" as used herein means a material that is miscible in a polar solvent. In one example, a polar solvent-soluble material is miscible in alcohol and/or water. In other words, a polar solvent-soluble material is a material that is capable of forming a stable (does not phase separate for greater than 5 minutes after forming the homogeneous solution) homogeneous solution with a polar solvent, such as alcohol and/or water at ambient conditions.

"Alcohol-soluble material" as used herein means a material that is miscible in alcohol. In other words, a material that is capable of forming a stable (does not phase separate for greater than 5 minutes after forming the homogeneous solution) homogeneous solution with an alcohol at ambient conditions.

"Water-soluble material" as used herein means a material that is miscible in water. In other words, a material that is capable of forming a stable (does not separate for greater than 5 minutes after forming the homogeneous solution) homogeneous solution with water at ambient conditions.

"Non-polar solvent-soluble material" as used herein means a material that is miscible in a non-polar solvent. In other words, a non-polar solvent-soluble material is a material that is capable of forming a stable (does not phase separate for greater than 5 minutes after forming the homogeneous solution) homogeneous solution with a non-polar solvent.

"Ambient conditions" as used herein means 73° F.±4° F. (about 23° C.±2.2° C.) and a relative humidity of 50%±10%.

"Weight average molecular weight" as used herein means the weight average molecular weight as determined using the Weight Average Molecular Weight Test Method described herein.

"Length" as used herein, with respect to a fibrous element, means the length along the longest axis of the fibrous element from one terminus to the other terminus. If a fibrous element has a kink, curl or curves in it, then the length is the length along the entire path of the fibrous element.

"Diameter" as used herein, with respect to a fibrous element, is measured according to the Diameter Test Method described herein. In one example, a fibrous element of the present invention exhibits a diameter of less than 100 μm and/or less than 75 μm and/or less than 50 μm and/or less than 25 μm and/or less than 20 μm and/or less than 15 μm and/or less than 10 μm and/or less than 6 μm and/or greater than 1 μm and/or greater than 3 μm.

"Triggering condition" as used herein in one example means anything, as an act or event, that serves as a stimulus and initiates or precipitates a change in the fibrous element, such as a loss or altering of the fibrous element's physical structure and/or a release of an additive, such as an active agent. In another example, the triggering condition may be present in an environment, such as water, when a fibrous element and/or fibrous structure and/or film of the present invention are added to the water. In other words, nothing changes in the water except for the fact that the fibrous element and/or fibrous structure and/or film of the present invention are added to the water.

"Morphology changes" as used herein with respect to a fibrous element's morphology changing means that the fibrous element experiences a change in its physical structure. Non-limiting examples of morphology changes for a fibrous element of the present invention include dissolution, melting, swelling, shrinking, breaking into pieces, exploding, lengthening, shortening, and combinations thereof. The fibrous elements of the present invention may completely or substantially lose their fibrous element physical structure or they may have their morphology changed or they may retain or substantially retain their fibrous element physical structure as they are exposed to conditions of intended use.

"By weight on a dry fibrous element basis and/or dry fibrous structure basis" means that the weight of the fibrous element and/or fibrous structure measured immediately after the fibrous element and/or fibrous structure has been conditioned in a conditioned room at a temperature of 23° C.±1° C. and a relative humidity of 50%±2% for 2 hours. In one example, "by weight on a dry fibrous element basis and/or dry fibrous structure basis" means that the fibrous element and/or fibrous structure comprises less than 20% and/or less than 15% and/or less than 10% and/or less than 7% and/or less than 5% and/or less than 3% and/or to 0% and/or to greater than 0% based on the weight of the fibrous element and/or fibrous structure of moisture, such as water, for example free water, as measured according to the Water Content Test Method described herein.

"Total level" as used herein, for example with respect to the total level of one or more active agents present in the fibrous element and/or fibrous structure, means the sum of the weights or weight percent of all of the subject materials, for example active agents. In other words, a fibrous element and/or fibrous structure may comprise 25% by weight on a dry fibrous element basis and/or dry fibrous structure basis of an anionic surfactant, 15% by weight on a dry fibrous element basis and/or dry fibrous structure basis of a nonionic surfactant, 10% by weight of a chelant, and 5% of a perfume so that the total level of active agents present in the fibrous element is greater than 50%; namely 55% by weight on a dry fibrous element basis and/or dry fibrous structure basis.

"Detergent product" as used herein means a solid form, for example a rectangular solid, sometimes referred to as a sheet, that comprises one or more active agents, for example a fabric care active agent, a dishwashing active agent, a hard surface active agent, and mixtures thereof. In one example, a detergent product of the present invention comprises one or more surfactants, one or more enzymes, one or more perfumes and/or one or more suds suppressors. In another example, a detergent product of the present invention comprises a builder and/or a chelating agent. In another example, a detergent product of the present invention comprises a bleaching agent.

In one example, the detergent product comprises a fibrous structure, for example a fibrous structure.

"Different from" or "different" as used herein means, with respect to a material, such as a fibrous element as a whole and/or a fibrous element-forming material within a fibrous element and/or an active agent within a fibrous element, that one material, such as a fibrous element and/or a fibrous element-forming material and/or an active agent, is chemically, physically and/or structurally different from another material, such as a fibrous element and/or a fibrous element-forming material and/or an active agent. For example, a fibrous element-forming material in the form of a filament is different from the same fibrous element-forming material in the form of a fiber. Likewise, starch is different from cellulose. However, different molecular weights of the same material, such as different molecular weights of a starch, are not different materials from one another for purposes of the present invention.

"Random mixture of polymers" as used herein means that two or more different fibrous element-forming materials are randomly combined to form a fibrous element. Accordingly, two or more different fibrous element-forming materials that are orderly combined to form a fibrous element, such as a core and sheath bicomponent fibrous element, is not a random mixture of different fibrous element-forming materials for purposes of the present invention.

"Associate," "Associated," "Association," and/or "Associating" as used herein with respect to fibrous elements and/or particle means combining, either in direct contact or in indirect contact, fibrous elements and/or particles such that a fibrous structure is formed. In one example, the associated fibrous elements and/or particles may be bonded together for example by adhesives and/or thermal bonds. In another example, the fibrous elements and/or particles may be associated with one another by being deposited onto the same fibrous structure making belt and/or patterned belt.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Fibrous Structure

The fibrous structures, for example soluble fibrous structures, of the present invention comprise a plurality of fibrous elements, for example a plurality of filaments, one or more active agents and one or more deterrent agents. In one example, the plurality of fibrous elements is inter-entangled to form a fibrous structure, for example a soluble fibrous structure.

In one example of the present invention, the fibrous structure is a soluble fibrous structure.

In one example of the present invention, the soluble fibrous structure is a water-soluble fibrous structure.

In another example of the present invention, the fibrous structure is an apertured fibrous structure. In one example, the fibrous structure is a water-soluble fibrous structure comprising a plurality of apertures. The apertures may be arranged in a non-random, repeating pattern within the fibrous structures of the present invention.

When present in the fibrous structures, the apertures may be of virtually any shape and size. In one example, the apertures are generally round or oblong shaped, in a regular pattern of spaced apart openings. The apertures can each have a diameter of from about 0.1 to about 2 mm and/or from about 0.5 to about 1 mm. The apertures may form an open area within an apertured, water-soluble fibrous structure of from about 0.5% to about 25% and/or from about 1% to about 20% and/or from about 2% to about 10%. It is believed that the benefits of the present invention can be realized with non-repeating and/or non-regular patterns of apertures having various shapes and sizes. Aperturing of fibrous structures, for example water-soluble fibrous structures, can be accomplished by any number of techniques. For example, aperturing can be accomplished by various processes involving bonding and stretching, such as those described in U.S. Pat. Nos. 3,949,127 and 5,873,868. In one embodiment, the apertures may be formed by forming a plurality of spaced, melt stabilized regions, and then ring-rolling the fibrous structure to stretch the fibrous structure and form apertures in the melt stabilized regions, as described in U.S. Pat. Nos. 5,628,097 and 5,916,661, both of which are hereby incorporated by reference herein. In another embodiment, apertures can be formed in a multi-layer, fibrous structure configuration by the method described in U.S. Pat. Nos. 6,830,800 and 6,863,960 which are hereby incorporated herein by reference. Still another process for aperturing fibrous structures is described in U.S. Pat. No. 8,241,543 entitled "Method And Apparatus For Making An Apertured Fibrous structure", which is hereby incorporated herein by reference.

In one example, the fibrous structure, for example soluble fibrous structure, comprises a plurality of identical or substantially identical from a compositional perspective of fibrous elements according to the present invention. In another example, the fibrous structure, for example soluble fibrous structure, may comprise two or more different fibrous elements according to the present invention. Non-limiting examples of differences in the fibrous elements may be physical differences such as differences in diameter, length, texture, shape, rigidness, elasticity, and the like; chemical differences such as crosslinking level, solubility, melting point, Tg, active agent, fibrous element-forming material, color, level of active agent, basis weight, level of fibrous element-forming material, presence of any coating on fibrous element, biodegradable or not, hydrophobic or not, contact angle, and the like; differences in whether the fibrous element loses its physical structure when the fibrous element is exposed to conditions of intended use; differences in whether the fibrous element's morphology changes when the fibrous element is exposed to conditions of intended use; and differences in rate at which the fibrous element releases one or more of its active agents when the fibrous element is exposed to conditions of intended use. In one example, two or more fibrous elements and/or particles within the fibrous structure may comprise different active agents. This may be the case where the different active agents may be incompatible with one another, for example an anionic surfactant (such as a shampoo active agent) and a cationic surfactant (such as a hair conditioner active agent).

In another example, the fibrous structure, for example soluble fibrous structure, may exhibit different regions, such as different regions of basis weight, density, and/or caliper. In yet another example, the fibrous structure, for example soluble fibrous structure, may comprise texture on one or more of its surfaces. A surface of the fibrous structure, for example soluble fibrous structure, may comprise a pattern, such as a non-random, repeating pattern. The fibrous structure, for example soluble fibrous structure, may be embossed with an emboss pattern.

In one example, the fibrous structure may comprise discrete regions of fibrous elements that differ from other parts of the fibrous structure. Non-limiting examples of different regions within fibrous structures are described in U.S. Published Patent Application Nos. 2013/0171421 and 2013/0167305 incorporated herein by reference.

The fibrous structure of the present invention may comprise a plurality of particles, for example particles comprising active agents, particles comprising deterrent agents, and particles comprising both active agents and deterrent agents. Non-limiting examples of fibrous structures comprising particles comprising active agents are described in U.S. Published Patent Application No. 2013/0172226 incorporated herein by reference.

The fibrous structure of the present invention may be used as is or may be coated with one or more active agents and/or one or more deterrent agents.

One or more, and/or a plurality of fibrous elements of the present invention may form a fibrous structure by any suitable process known in the art. The fibrous structure may be used to deliver active agents from the fibrous elements of the present invention when the fibrous structure is exposed to conditions of intended use of the fibrous elements and/or fibrous structure.

The fibrous structures of the present invention may comprise a plurality of identical or substantially identical from a compositional perspective fibrous elements according to the present invention. In another example, the fibrous structure may comprise two or more different fibrous elements according to the present invention. Non-limiting examples of differences in the fibrous elements may be physical differences such as differences in diameter, length, texture, shape, rigidness, elasticity, and the like; chemical differences such as crosslinking level, solubility, melting point, Tg, active agent, fibrous element-forming material, color, level of active agent, level of fibrous element-forming material, presence of any coating on fibrous element, biodegradable or not, hydrophobic or not, contact angle, and the like; differences in whether the fibrous element loses its physical structure when the fibrous element is exposed to conditions of intended use; differences in whether the fibrous element's morphology changes when the fibrous element is exposed to conditions of intended use; and differences in rate at which the fibrous element releases one or more of its active agents when the fibrous element is exposed to conditions of intended use. In one example, two or more fibrous elements within the fibrous structure may comprise the same fibrous element-forming material, but have different active agents. This may be the case where the different active agents may be incompatible with one another, for example an anionic surfactant (such as a shampoo active agent) and a cationic surfactant (such as a hair conditioner active agent).

A fibrous structure of the present invention may comprise two or more different layers (in the z-direction of the fibrous structure) of fibrous elements, for example filaments, of the present invention that form the fibrous structure. The fibrous elements in one layer may be the same as or different from the fibrous elements in another layer. Each layer may comprise a plurality of identical or substantially identical or different fibrous elements. For example, fibrous elements that may release their active agents at a faster rate than others within the fibrous structure may be positioned as an external surface of the fibrous structure. In addition to the fibrous elements, one or more of the layers may comprise one or more particles, for example active agent-containing particles and/or deterrent agent-containing particles dispersed throughout the layers and/or throughout the fibrous structure. In addition and/or alternatively, one or more surfaces of the fibrous structure may comprise one or more active agents and/or one or more deterrent agents.

Non-limiting examples of use of the fibrous structure of the present invention include, but are not limited to a laundry dryer substrate, washing machine substrate, washcloth, hard surface cleaning and/or polishing substrate, floor cleaning and/or polishing substrate, as a component in a battery, baby wipe, adult wipe, feminine hygiene wipe, bath tissue wipe, window cleaning substrate, oil containment and/or scavenging substrate, insect repellant substrate, swimming pool chemical substrate, food, breath freshener, deodorant, waste disposal bag, packaging film and/or wrap, wound dressing, medicine delivery, building insulation, crops and/or plant cover and/or bedding, glue substrate, skin care substrate, hair care substrate, air care substrate, water treatment substrate and/or filter, toilet bowl cleaning substrate, candy substrate, pet food, livestock bedding, teeth whitening substrates, carpet cleaning substrates, and other suitable uses of the active agents of the present invention.

In one example, a fibrous structure of the present invention exhibits an average disintegration time of about 60 seconds (s) or less, and/or about 30 s or less, and/or about 10 s or less, and/or about 5 s or less, and/or about 2.0 s or less, and/or 1.5 s or less as measured according to the Dissolution Test Method described herein.

In one example, a fibrous structure of the present invention exhibits an average dissolution time of about 600 seconds (s) or less, and/or about 400 s or less, and/or about 300 s or less, and/or about 200 s or less, and/or about 175 s or less as measured according to the Dissolution Test Method described herein.

In one example, a fibrous structure of the present invention exhibits an average disintegration time per gsm of sample of about 1.0 second/gsm (s/gsm) or less, and/or about 0.5 s/gsm or less, and/or about 0.2 s/gsm or less, and/or about 0.1 s/gsm or less, and/or about 0.05 s/gsm or less, and/or about 0.03 s/gsm or less as measured according to the Dissolution Test Method described herein.

In one example, a fibrous structure of the present invention exhibits an average dissolution time per gsm of sample of about 10 seconds/gsm (s/gsm) or less, and/or about 5.0 s/gsm or less, and/or about 3.0 s/gsm or less, and/or about 2.0 s/gsm or less, and/or about 1.8 s/gsm or less, and/or about 1.5 s/gsm or less as measured according to the Dissolution Test Method described herein.

In certain embodiments, suitable fibrous structures can have a water content (% moisture) from 0% to about 20%; in certain embodiments, fibrous structures can have a water content from about 1% to about 15%; and in certain embodiments, fibrous structures can have a water content from about 5% to about 10% as measured according to the Water Content Test Method described herein.

The fibrous elements and/or fibrous structures of the present invention exhibit improved cleaning compared to known fibrous structures as shown in Table 1 below.

TABLE 1

| Soil | REFERENCE PEO Web In Wash Concentration (36 ppm PEO 100K MW/144 ppm PVOH 505/90 ppm AE 1.8S/270 ppm LAS) (SRI) | PEO Web + 50 ppm Dispersant + 30 ppm AE1.8S (ΔSRI) | PEO Web + 50 ppm Dispersant + 30 ppm AE1.8S + Carbonate (ΔSRI) | Surfactant Only (90 ppm AE1.8S/270 ppm LAS) (from CLL Standards) (ΔSRI) | PVOH Web (36 ppm PVOH 420H/84 ppm PVOH 505/120 ppm AE1.0S/240 ppm LAS) (ΔSRI) | LSD |
|---|---|---|---|---|---|---|
| Black Todd Clay | 24.3 | 8.0 | 3.2 | 20.8 | −1.1 | 4.67 |
| US Clay | 31.3 | 0.7 | −2.9 | −0.9 | −4.0 | 5.57 |

Fibrous Elements

The fibrous element, such as a filament and/or fiber, of the present invention comprises one or more fibrous element-forming materials and a polyethylene oxide that exhibits a weight average molecular weight of greater than 10,000 g/mol but less than 500,000 g/mol as measured according to the Weight Average Molecular Weight Test Method. In addition to the fibrous element-forming materials and the polyethylene oxide, the fibrous element may further comprise one or more additional polyethylene oxides that exhibit a weight average molecular weight of at least 500,000 g/mol as measured according to the Weight Average Molecular Weight Test Method. The fibrous element may further comprise one or more active agents present within the fibrous element that are releasable from the fibrous element, for example a filament, such as when the fibrous element and/or fibrous structure comprising the fibrous element is exposed to conditions of intended use. In one example, the total level of the one or more fibrous element-forming materials present in the fibrous element is less than 80% by weight on a dry fibrous element basis and/or dry fibrous structure basis and the total level of the one or more active agents present in the fibrous element is greater than 20% by weight on a dry fibrous element basis and/or dry fibrous structure basis.

In one example, the fibrous element of the present invention comprises about 100% and/or greater than 95% and/or greater than 90% and/or greater than 85% and/or greater than 75% and/or greater than 50% by weight on a dry fibrous element basis and/or dry fibrous structure basis of one or more fibrous element-forming materials. For example, the fibrous element-forming material may comprise polyvinyl alcohol, starch, modified starches such as propoxylated starch and/or ethoxylated starch, modified celulluoses such as carboxymethylcellulose and/or hydroxypropylmethyl cellulose, and other suitable polymers, especially hydroxyl polymers.

In another example, the fibrous element of the present invention comprises one or more fibrous element-forming materials, a polyethylene oxide that exhibits a weight average molecular weight of greater than 10,000 g/mol but less than 500,000 g/mol as measured according to the Weight Average Molecular Weight Test Method, and one or more active agents wherein the total level of fibrous element-forming materials present in the fibrous element is from about 5% to less than 80% by weight on a dry fibrous element basis and/or dry fibrous structure basis and the total level of active agents present in the fibrous element is greater than 20% to about 95% by weight on a dry fibrous element basis and/or dry fibrous structure basis.

In one example, the fibrous element of the present invention comprises at least 10% and/or at least 15% and/or at least 20% and/or less than less than 80% and/or less than 75% and/or less than 65% and/or less than 60% and/or less than 55% and/or less than 50% and/or less than 45% and/or less than 40% by weight on a dry fibrous element basis and/or dry fibrous structure basis of the fibrous element-forming materials and greater than 20% and/or at least 35% and/or at least 40% and/or at least 45% and/or at least 50% and/or at least 60% and/or less than 95% and/or less than 90% and/or less than 85% and/or less than 80% and/or less than 75% by weight on a dry fibrous element basis and/or dry fibrous structure basis of active agents.

In one example, the fibrous element of the present invention comprises at least 5% and/or at least 10% and/or at least 15% and/or at least 20% and/or less than 50% and/or less than 45% and/or less than 40% and/or less than 35% and/or less than 30% and/or less than 25% by weight on a dry fibrous element basis and/or dry fibrous structure basis of the fibrous element-forming materials and greater than 50% and/or at least 55% and/or at least 60% and/or at least 65% and/or at least 70% and/or less than 95% and/or less than 90% and/or less than 85% and/or less than 80% and/or less than 75% by weight on a dry fibrous element basis and/or dry fibrous structure basis of active agents. In one example, the fibrous element of the present invention comprises greater than 80% by weight on a dry fibrous element basis and/or dry fibrous structure basis of active agents.

In another example, the one or more fibrous element-forming materials and active agents are present in the fibrous element at a weight ratio of total level of fibrous element-forming materials to active agents of 4.0 or less and/or 3.5 or less and/or 3.0 or less and/or 2.5 or less and/or 2.0 or less and/or 1.85 or less and/or less than 1.7 and/or less than 1.6 and/or less than 1.5 and/or less than 1.3 and/or less than 1.2 and/or less than 1 and/or less than 0.7 and/or less than 0.5 and/or less than 0.4 and/or less than 0.3 and/or greater than 0.1 and/or greater than 0.15 and/or greater than 0.2.

In still another example, the fibrous element of the present invention comprises from about 10% and/or from about 15% to less than 80% by weight on a dry fibrous element basis and/or dry fibrous structure basis of a fibrous element-forming material, such as polyvinyl alcohol polymer, starch polymer, and/or carboxymethylcellulose polymer, and greater than 20% to about 90% and/or to about 85% by weight on a dry fibrous element basis and/or dry fibrous structure basis of an active agent. The fibrous element may further comprise a plasticizer, such as glycerin and/or pH adjusting agents, such as citric acid.

In yet another example, the fibrous element of the present invention comprises from about 10% and/or from about 15% to less than 80% by weight on a dry fibrous element basis and/or dry fibrous structure basis of a fibrous element-forming material, such as polyvinyl alcohol polymer, starch polymer, and/or carboxymethylcellulose polymer, and greater than 20% to about 90% and/or to about 85% by weight on a dry fibrous element basis and/or dry fibrous structure basis of an active agent, wherein the weight ratio of fibrous element-forming material to active agent is 4.0 or less. The fibrous element may further comprise a plasticizer, such as glycerin and/or pH adjusting agents, such as citric acid.

In even another example of the present invention, a fibrous element comprises one or more fibrous element-forming materials and one or more active agents selected from the group consisting of: enzymes, bleaching agents, builder, chelants, sensates, dispersants, and mixtures thereof that are releasable and/or released when the fibrous element and/or fibrous structure comprising the fibrous element is exposed to conditions of intended use. In one example, the fibrous element comprises a total level of fibrous element-forming materials of less than 95% and/or less than 90% and/or less than 80% and/or less than 50% and/or less than 35% and/or to about 5% and/or to about 10% and/or to about 20% by weight on a dry fibrous element basis and/or dry fibrous structure basis and a total level of active agents selected from the group consisting of: enzymes, bleaching agents, builder, chelants, perfumes, antimicrobials, antibacterials, antifungals, and mixtures thereof of greater than 5% and/or greater than 10% and/or greater than 20% and/or greater than 35% and/or greater than 50% and/or greater than 65% and/or to about 95% and/or to about 90% and/or to about 80% by weight on a dry fibrous element basis and/or dry fibrous structure basis. In one example, the active agent comprises one or more enzymes. In another example, the active agent comprises one or more bleaching agents. In yet another example, the active agent comprises one or more builders. In still another example, the active agent comprises one or more chelants. In still another example, the active agent comprises one or more perfumes. In even still another example, the active agent comprises one or more antimicrobials, antibacterials, and/or antifungals.

In yet another example of the present invention, the fibrous elements of the present invention may comprise active agents that may create health and/or safety concerns if they become airborne. For example, the fibrous element may be used to inhibit enzymes within the fibrous element from becoming airborne.

In one example, the fibrous elements of the present invention may be meltblown fibrous elements. In another example, the fibrous elements of the present invention may be spunbond fibrous elements. In another example, the fibrous elements may be hollow fibrous elements prior to and/or after release of one or more of its active agents.

The fibrous elements of the present invention may be hydrophilic or hydrophobic. The fibrous elements may be surface treated and/or internally treated to change the inherent hydrophilic or hydrophobic properties of the fibrous element.

In one example, the fibrous element exhibits a diameter of less than 100 μm and/or less than 75 μm and/or less than 50 μm and/or less than 25 μm and/or less than 10 μm and/or less than 5 μm and/or less than 1 μm as measured according to the Diameter Test Method described herein. In another example, the fibrous element of the present invention exhibits a diameter of greater than 1 μm as measured according to the Diameter Test Method described herein. The diameter of a fibrous element of the present invention may be used to control the rate of release of one or more active agents present in the fibrous element and/or the rate of loss and/or altering of the fibrous element's physical structure.

The fibrous element may comprise two or more different active agents. In one example, the fibrous element comprises two or more different active agents, wherein the two or more different active agents are compatible with one another. In another example, the fibrous element comprises two or more different active agents, wherein the two or more different active agents are incompatible with one another.

In one example, the fibrous element may comprise an active agent within the fibrous element and an active agent on an external surface of the fibrous element, such as an active agent coating on the fibrous element. The active agent on the external surface of the fibrous element may be the same or different from the active agent present in the fibrous element. If different, the active agents may be compatible or incompatible with one another.

In one example, one or more active agents may be uniformly distributed or substantially uniformly distributed throughout the fibrous element. In another example, one or more active agents may be distributed as discrete regions within the fibrous element. In still another example, at least one active agent is distributed uniformly or substantially uniformly throughout the fibrous element and at least one other active agent is distributed as one or more discrete regions within the fibrous element. In still yet another example, at least one active agent is distributed as one or more discrete regions within the fibrous element and at least one other active agent is distributed as one or more discrete regions different from the first discrete regions within the fibrous element.

The fibrous structures and/or products of the present invention may also comprise a graphic or indicia which conveys and/or communicates to a user or observer of the fibrous structure and/or product that the fibrous structure and/or product comprises one or more deterrent agents. While it is important for the fibrous structure and/or product simply to comprise one or more deterrent agents, a visual signal which communicates the presence of and/or is previously associated with the one or more deterrent agents may assist in further achievement of the goal of mitigating the risk of accidental ingestion by humans. Alternatively, the graphic or indicia itself might comprise both the visual signal graphic and the one or more deterrent agents. Further non-limiting examples of fibrous structures and/or products that include graphics and/or indicia is found in U.S. patent application Ser. No. 14/558,829 filed Dec. 3, 2014, which is incorporated herein by reference.

The term "graphic" or "indicia" refers to images or designs that may be constituted by a figure (e.g., a line(s)), a symbol or character, a single color symbol or character, a color difference or transition of at least two colors, a multiple color symbol or character, or the like. A graphic may include an aesthetic image or design that can provide certain benefit(s) when viewed. A graphic may be in the form of a photographic image. A graphic may also be in the form of a 1-dimensional (1-D) or 2-dimensional (2-D) bar code or a quick response (QR) bar code. A graphic design is determined by, for example, the color(s) used in the graphic (individual pure ink or spot colors as well as built process colors), the sizes of the entire graphic (or components of the graphic), the positions of the graphic (or components of the graphic), the movements of the graphic (or components of the graphic), the geometrical shapes of the graphic (or components of the graphics), the number of colors in the graphic, the variations of the color combinations in the graphic, the number of graphics printed, the disappearance of color(s) in the graphic, and the contents of text messages in the graphic.

Fibrous Element-Forming Material

The fibrous element-forming material is any suitable material, such as a polymer or monomers capable of producing a polymer that exhibits properties suitable for making a fibrous element, such as by a spinning process.

In one example, the fibrous element-forming material may comprise a polar solvent-soluble material, such as an alcohol-soluble material and/or a water-soluble material.

In another example, the fibrous element-forming material may comprise a non-polar solvent-soluble material.

In still another example, the filament forming material may comprise a polar solvent-soluble material and be free (less than 5% and/or less than 3% and/or less than 1% and/or 0% by weight on a dry fibrous element basis and/or dry fibrous structure basis) of non-polar solvent-soluble materials.

In yet another example, the fibrous element-forming material may be a film-forming material. In still yet another example, the fibrous element-forming material may be synthetic or of natural origin and it may be chemically, enzymatically, and/or physically modified.

In even another example of the present invention, the fibrous element-forming material may comprise a polymer selected from the group consisting of: polymers derived from acrylic monomers such as the ethylenically unsaturated carboxylic monomers and ethylenically unsaturated monomers, polyvinyl alcohol, polyacrylates, polymethacrylates, copolymers of acrylic acid and methyl acrylate, polyvinylpyrrolidones, polyalkylene oxides, starch and starch derivatives, pullulan, gelatin, hydroxypropylmethylcelluloses, methycelluloses, and carboxymethycelluloses.

In still another example, the fibrous element-forming material may comprises a polymer selected from the group consisting of: polyvinyl alcohol, polyvinyl alcohol derivatives, starch, starch derivatives, cellulose derivatives, hemicellulose, hemicellulose derivatives, proteins, sodium alginate, hydroxypropyl methylcellulose, chitosan, chitosan derivatives, polyethylene glycol, tetramethylene ether glycol, polyvinyl pyrrolidone, hydroxymethyl cellulose, hydroxyethyl cellulose, and mixtures thereof.

In another example, the fibrous element-forming material comprises a polymer is selected from the group consisting of: pullulan, hydroxypropylmethyl cellulose, hydroxyethyl cellulose, hydroxypropyl cellulose, polyvinyl pyrrolidone, carboxymethyl cellulose, sodium alginate, xanthan gum, tragacanth gum, guar gum, acacia gum, Arabic gum, polyacrylic acid, methylmethacrylate copolymer, carboxyvinyl polymer, dextrin, pectin, chitin, levan, elsinan, collagen, gelatin, zein, gluten, soy protein, casein, polyvinyl alcohol, starch, starch derivatives, hemicellulose, hemicellulose derivatives, proteins, chitosan, chitosan derivatives, polyethylene glycol, tetramethylene ether glycol, hydroxymethyl cellulose, and mixtures thereof.

Polar Solvent-Soluble Materials

Non-limiting examples of polar solvent-soluble materials include polar solvent-soluble polymers. The polar solvent-soluble polymers may be synthetic or natural original and may be chemically and/or physically modified. In one example, the polar solvent-soluble polymers exhibit a weight average molecular weight of at least 10,000 g/mol and/or at least 20,000 g/mol and/or at least 40,000 g/mol and/or at least 80,000 g/mol and/or at least 100,000 g/mol and/or at least 1,000,000 g/mol and/or at least 3,000,000 g/mol and/or at least 10,000,000 g/mol and/or at least 20,000,000 g/mol and/or to about 40,000,000 g/mol and/or to about 30,000,000 g/mol.

In one example, the polar solvent-soluble polymers are selected from the group consisting of: alcohol-soluble polymers, water-soluble polymers and mixtures thereof. Non-limiting examples of water-soluble polymers include water-soluble hydroxyl polymers, water-soluble thermoplastic polymers, water-soluble biodegradable polymers, water-soluble non-biodegradable polymers and mixtures thereof. In one example, the water-soluble polymer comprises polyvinyl alcohol. In another example, the water-soluble polymer comprises starch. In yet another example, the water-soluble polymer comprises polyvinyl alcohol and starch.

a. Water-Soluble Hydroxyl Polymers—

Non-limiting examples of water-soluble hydroxyl polymers in accordance with the present invention include polyols, such as polyvinyl alcohol, polyvinyl alcohol derivatives, polyvinyl alcohol copolymers, starch, starch derivatives, starch copolymers, chitosan, chitosan derivatives, chitosan copolymers, cellulose derivatives such as cellulose ether and ester derivatives, cellulose copolymers, hemicellulose, hemicellulose derivatives, hemicellulose copolymers, gums, arabinans, galactans, proteins and various other polysaccharides and mixtures thereof.

In one example, a water-soluble hydroxyl polymer of the present invention comprises a polysaccharide.

"Polysaccharides" as used herein means natural polysaccharides and polysaccharide derivatives and/or modified polysaccharides. Suitable water-soluble polysaccharides include, but are not limited to, starches, starch derivatives, chitosan, chitosan derivatives, cellulose derivatives, hemicellulose, hemicellulose derivatives, gums, arabinans, galactans and mixtures thereof. The water-soluble polysaccharide may exhibit a weight average molecular weight of from about 10,000 to about 40,000,000 g/mol and/or greater than 100,000 g/mol and/or greater than 1,000,000 g/mol and/or greater than 3,000,000 g/mol and/or greater than 3,000,000 to about 40,000,000 g/mol.

The water-soluble polysaccharides may comprise non-cellulose and/or non-cellulose derivative and/or non-cellulose copolymer water-soluble polysaccharides. Such non-cellulose water-soluble polysaccharides may be selected from the group consisting of: starches, starch derivatives, chitosan, chitosan derivatives, hemicellulose, hemicellulose derivatives, gums, arabinans, galactans and mixtures thereof.

In another example, a water-soluble hydroxyl polymer of the present invention comprises a non-thermoplastic polymer.

The water-soluble hydroxyl polymer may have a weight average molecular weight of from about 10,000 g/mol to about 40,000,000 g/mol and/or greater than 100,000 g/mol and/or greater than 1,000,000 g/mol and/or greater than 3,000,000 g/mol and/or greater than 3,000,000 g/mol to about 40,000,000 g/mol. Higher and lower molecular weight water-soluble hydroxyl polymers may be used in combination with hydroxyl polymers having a certain desired weight average molecular weight.

Well known modifications of water-soluble hydroxyl polymers, such as natural starches, include chemical modifications and/or enzymatic modifications. For example, natural starch can be acid-thinned, hydroxy-ethylated, hydroxy-propylated, and/or oxidized. In addition, the water-soluble hydroxyl polymer may comprise dent corn starch.

Naturally occurring starch is generally a mixture of linear amylose and branched amylopectin polymer of D-glucose units. The amylose is a substantially linear polymer of D-glucose units joined by (1,4)-α-D links. The amylopectin is a highly branched polymer of D-glucose units joined by (1,4)-α-D links and (1,6)-α-D links at the branch points. Naturally occurring starch typically contains relatively high levels of amylopectin, for example, corn starch (64-80% amylopectin), waxy maize (93-100% amylopectin), rice (83-84% amylopectin), potato (about 78% amylopectin), and wheat (73-83% amylopectin). Though all starches are potentially useful herein, the present invention is most commonly practiced with high amylopectin natural starches derived from agricultural sources, which offer the advantages of being abundant in supply, easily replenishable and inexpensive.

As used herein, "starch" includes any naturally occurring unmodified starches, modified starches, synthetic starches and mixtures thereof, as well as mixtures of the amylose or amylopectin fractions; the starch may be modified by physical, chemical, or biological processes, or combinations thereof. The choice of unmodified or modified starch for the present invention may depend on the end product desired. In one embodiment of the present invention, the starch or starch mixture useful in the present invention has an amylopectin content from about 20% to about 100%, more typically from about 40% to about 90%, even more typically from about 60% to about 85% by weight of the starch or mixtures thereof.

Suitable naturally occurring starches can include, but are not limited to, corn starch, potato starch, sweet potato starch, wheat starch, sago palm starch, tapioca starch, rice starch, soybean starch, arrow root starch, amioca starch, bracken starch, lotus starch, waxy maize starch, and high amylose corn starch. Naturally occurring starches particularly, corn starch and wheat starch, are the preferred starch polymers due to their economy and availability.

Polyvinyl alcohols herein can be grafted with other monomers to modify its properties. A wide range of monomers has been successfully grafted to polyvinyl alcohol. Non-limiting examples of such monomers include vinyl acetate, styrene, acrylamide, acrylic acid, 2-hydroxyethyl methacrylate, acrylonitrile, 1,3-butadiene, methyl methacrylate, methacrylic acid, maleic acid, itaconic acid, sodium vinylsulfonate, sodium allylsulfonate, sodium methylallyl sulfonate, sodium phenylallylether sulfonate, sodium phenylmethallylether sulfonate, 2-acrylamido-methyl propane sulfonic acid (AMPs), vinylidene chloride, vinyl chloride, vinyl amine and a variety of acrylate esters.

In one example, the water-soluble hydroxyl polymer is selected from the group consisting of: polyvinyl alcohols, hydroxymethylcelluloses, hydroxyethylcelluloses, hydroxypropylmethylcelluloses and mixtures thereof. A non-limiting example of a suitable polyvinyl alcohol includes those commercially available from Sekisui Specialty Chemicals America, LLC (Dallas, Tex.) under the CELVOL® trade name A non-limiting example of a suitable hydroxypropylmethylcellulose includes those commercially available from the Dow Chemical Company (Midland, Mich.) under the METHOCEL® trade name including combinations with above mentioned hydroxypropylmethylcelluloses.

b. Water-Soluble Thermoplastic Polymers—

Non-limiting examples of suitable water-soluble thermoplastic polymers include thermoplastic starch and/or starch derivatives, polylactic acid, polyhydroxyalkanoate, polycaprolactone, polyesteramides and certain polyesters, and mixtures thereof.

The water-soluble thermoplastic polymers of the present invention may be hydrophilic or hydrophobic. The water-soluble thermoplastic polymers may be surface treated and/or internally treated to change the inherent hydrophilic or hydrophobic properties of the thermoplastic polymer.

The water-soluble thermoplastic polymers may comprise biodegradable polymers.

Any suitable weight average molecular weight for the thermoplastic polymers may be used. For example, the weight average molecular weight for a thermoplastic polymer in accordance with the present invention is greater than about 10,000 g/mol and/or greater than about 40,000 g/mol and/or greater than about 50,000 g/mol and/or less than about 500,000 g/mol and/or less than about 400,000 g/mol and/or less than about 200,000 g/mol.

Non-Polar Solvent-Soluble Materials

Non-limiting examples of non-polar solvent-soluble materials include non-polar solvent-soluble polymers. Non-limiting examples of suitable non-polar solvent-soluble materials include cellulose, chitin, chitin derivatives, polyolefins, polyesters, copolymers thereof, and mixtures thereof. Non-limiting examples of polyolefins include polypropylene, polyethylene and mixtures thereof. A non-limiting example of a polyester includes polyethylene terephthalate.

The non-polar solvent-soluble materials may comprise a non-biodegradable polymer such as polypropylene, polyethylene and certain polyesters.

Any suitable weight average molecular weight for the thermoplastic polymers may be used. For example, the weight average molecular weight for a thermoplastic polymer in accordance with the present invention is greater than about 10,000 g/mol and/or greater than about 40,000 g/mol and/or greater than about 50,000 g/mol and/or less than about 500,000 g/mol and/or less than about 400,000 g/mol and/or less than about 200,000 g/mol.

Polyethylene Oxides

The fibrous element of the present invention comprises a polyethylene oxide that exhibits a weight average molecular weight of greater than 10,000 g/mol but less than 500,000 g/mol as measured according to the Weight Average Molecular Weight Test Method.

The polyethylene oxide (first polyethylene oxide) may exhibit a weight average molecular weight of greater than 25,000 g/mol but less than 500,000 g/mol and/or greater than 35,000 g/mol but less than 400,000 g/mol and/or at least 50,000 g/mol but less than 400,000 g/mol and/or at least 50,000 g/mol but less than 350,000 g/mol and/or at least 75,000 g/mol but less than 300,000 g/mol and/or at least 75,000 g/mol but less than 250,000 g/mol and/or at least 90,000 g/mol but less than 250,000 g/mol and/or at least 100,000 g/mol to about 200,000 g/mol and/or as measured according to the Weight Average Molecular Weight Test Method.

In addition to the first polyethylene oxide described above, the fibrous element may further comprise a second polyethylene oxide. The second polyethylene oxide exhibits a weight average molecular weight of at least 500,000 g/mol and/or at least 500,000 g/mol to less than 25,000,000 g/mol and/or at least 750,000 g/mot to less than 15,000,000 g/mol and/or at least 750,000 g/mol to less than 10,000,000 g/mol and/or at least 1,000,000 g/mol to less than 10,000,000 g/mol and/or at least 2,000,000 g/mol to less than 8,000,000 g/mol and/or at least 2,000,000 g/mol to less than 4,000,000 g/mol and/or as measured according to the Weight Average Molecular Weight Test Method.

The second polyethylene oxide may serve the function as an extensional aid.

In one example, the first polyethylene oxide and the second polyethylene oxide, when present, are present in the fibrous element at a weight ratio of the first polyethylene oxide to the second polyethylene oxide of at least 1:2 and/or at least 1:1 and/or least 1.5:1 and/or at least 2:1 and/or at least 3:1 and/or at least 5:1 and/or at least 10:1 and/or at least 50:1 and/or 100:1.

In one example, the first polyethylene oxide is present in the fibrous element at a level of at least 0.01% and/or from about 0.01% to about 25% and/or from about 0.05% to about 20% and/or from about 0.5% to about 15% and/or from about 0.5% to about 10% and/or from about 0.5% to about 5% by weight on a dry fibrous element basis and/or dry fibrous structure basis.

In another example, the second polyethylene oxide is present in the fibrous element at a level of at least 0.001% and/or from about 0.001% to about 15% and/or from about 0.005% to about 10% and/or from about 0.01% to about 5% and/or from about 0.05% to about 1% and/or from about 0.05% to about 0.7% by weight on a dry fibrous element basis and/or dry fibrous structure basis.

Active Agents

Active agents are a class of additives that are designed and intended to provide a benefit to something other than the fibrous element and/or particle and/or fibrous structure itself, such as providing a benefit to an environment external to the fibrous element and/or particle and/or fibrous structure. Active agents may be any suitable additive that produces an intended effect under intended use conditions of the fibrous element. For example, the active agent may be selected from the group consisting of: personal cleansing and/or conditioning agents such as hair care agents such as shampoo agents and/or hair colorant agents, hair conditioning agents, skin care agents, sunscreen agents, and skin conditioning agents; laundry care and/or conditioning agents such as fabric care agents, fabric conditioning agents, fabric softening agents, fabric anti-wrinkling agents, fabric care anti-static agents, fabric care stain removal agents, soil release agents, dispersing agents, suds suppressing agents, suds boosting agents, anti-foam agents, and fabric refreshing agents; liquid and/or powder dishwashing agents (for hand dishwashing and/or automatic dishwashing machine applications), hard surface care agents, and/or conditioning agents and/or polishing agents; other cleaning and/or conditioning agents such as antimicrobial agents, antibacterial agents, antifungal agents, fabric hueing agents, perfume, bleaching agents (such as oxygen bleaching agents, hydrogen peroxide, percarbonate bleaching agents, perborate bleaching agents, chlorine bleaching agents), bleach activating agents, chelating agents, builders, lotions, brightening agents, air care agents, carpet care agents, dye transfer-inhibiting agents, clay soil removing agents, anti-redeposition agents, polymeric soil release agents, polymeric dispersing agents, alkoxylated polyamine polymers, alkoxylated polycarboxylate polymers, amphilic graft copolymers, dissolution aids, buffering systems, water-softening agents, water-hardening agents, pH adjusting agents, enzymes, flocculating agents, effervescent agents, preservatives, cosmetic agents, make-up removal agents, lathering agents, deposition aid agents, coacervate-forming agents, clays, thickening agents, latexes, silicas, drying agents, odor control agents, antiperspirant agents, cooling agents, warming agents, absorbent gel agents, anti-inflammatory agents, dyes, pigments, acids, and bases; liquid treatment active agents; agricultural active agents; industrial active agents; ingestible active agents such as medicinal agents, teeth whitening agents, tooth care agents, mouthwash agents, periodontal gum care agents, edible agents, dietary agents, vitamins, minerals; water-treatment agents such as water clarifying and/or water disinfecting agents, and mixtures thereof.

Non-limiting examples of suitable cosmetic agents, skin care agents, skin conditioning agents, hair care agents, and hair conditioning agents are described in CTFA Cosmetic Ingredient Handbook, Second Edition, The Cosmetic, Toiletries, and Fragrance Association, Inc. 1988, 1992.

One or more classes of chemicals may be useful for one or more of the active agents listed above. For example, surfactants may be used for any number of the active agents described above. Likewise, bleaching agents may be used for fabric care, hard surface cleaning, dishwashing and even teeth whitening. Therefore, one of ordinary skill in the art will appreciate that the active agents will be selected based upon the desired intended use of the fibrous element and/or particle and/or fibrous structure made therefrom.

For example, if the fibrous element and/or particle and/or fibrous structure made therefrom is to be used for hair care and/or conditioning then one or more suitable surfactants, such as a lathering surfactant could be selected to provide the desired benefit to a consumer when exposed to conditions of intended use of the fibrous element and/or particle and/or fibrous structure incorporating the fibrous element and/or particle.

In one example, if the fibrous element and/or particle and/or fibrous structure made therefrom is designed or intended to be used for laundering clothes in a laundry operation, then one or more suitable surfactants and/or enzymes and/or builders and/or perfumes and/or suds suppressors and/or bleaching agents could be selected to provide the desired benefit to a consumer when exposed to conditions of intended use of the fibrous element and/or particle and/or fibrous structure incorporating the fibrous element and/or particle. In another example, if the fibrous element and/or particle and/or fibrous structure made therefrom is designed to be used for laundering clothes in a laundry operation and/or cleaning dishes in a dishwashing operation, then the fibrous element and/or particle and/or fibrous structure may comprise a laundry detergent composition or dishwashing detergent composition or active agents used in such compositions. In still another example, if the fibrous element and/or particle and/or fibrous structure made therefrom is designed to be used for cleaning and/or sanitizing a toilet bowl, then the fibrous element and/or particle and/or fibrous structure made therefrom may comprise a toilet bowl cleaning composition and/or effervescent composition and/or active agents used in such compositions.

In one example, the active agent is selected from the group consisting of: surfactants, bleaching agents, enzymes, suds suppressors, suds boosting agents, fabric softening agents, denture cleaning agents, hair cleaning agents, hair care agents, personal health care agents, hueing agents, and mixtures thereof.

In one example, the active agent is selected from the group consisting of: $C_{12}$-$C_{22}$ fatty alcohols, fatty acids, behentrimonium methosulfate, benzyl trimethyl ammonium chloride, stearamidopropyl dimethylamine Surfactants Non-limiting examples of suitable surfactants include anionic surfactants, cationic surfactants, nonionic surfactants, zwitterionic surfactants, amphoteric surfactants, and mixtures thereof. Co-surfactants may also be included in the filaments. For filaments designed for use as laundry detergents and/or dishwashing detergents, the total level of surfactants should be sufficient to provide cleaning including stain and/or odor removal, and generally ranges from about 0.5% to about 95%. Further, surfactant systems comprising two or more surfactants that are designed for use in filaments for laundry detergents and/or dishwashing detergents may include all-anionic surfactant systems, mixed-type surfactant systems comprising anionic-nonionic surfactant mixtures, or nonionic-cationic surfactant mixtures or low-foaming nonionic surfactants.

The surfactants herein can be linear or branched. In one example, suitable linear surfactants include those derived from agrochemical oils such as coconut oil, palm kernel oil, soybean oil, or other vegetable-based oils.

a. Anionic Surfactants

Non-limiting examples of suitable anionic surfactants include alkyl sulfates, alkyl ether sulfates, branched alkyl sulfates, branched alkyl alkoxylates, branched alkyl alkoxylate sulfates, mid-chain branched alkyl aryl sulfonates, sulfated monoglycerides, sulfonated olefins, alkyl aryl sulfonates, primary or secondary alkane sulfonates, alkyl sulfosuccinates, acyl taurates, acyl isethionates, alkyl glycerylether sulfonate, sulfonated methyl esters, sulfonated fatty acids, alkyl phosphates, acyl glutamates, acyl sarcosinates, alkyl sulfoacetates, acylated peptides, alkyl ether carboxylates, acyl lactylates, anionic fluorosurfactants, sodium lauroyl glutamate, and combinations thereof.

Alkyl sulfates and alkyl ether sulfates suitable for use herein include materials with the respective formula $ROSO_3M$ and $RO(C_2H_4O)_xSO_3M$, wherein R is alkyl or alkenyl of from about 8 to about 24 carbon atoms, x is 1 to 10, and M is a water-soluble cation such as ammonium, sodium, potassium and triethanolamine Other suitable anionic surfactants are described in McCutcheon's Detergents and Emulsifiers, North American Edition (1986), Allured Publishing Corp. and McCutcheon's, Functional Materials, North American Edition (1992), Allured Publishing Corp.

In one example, anionic surfactants useful in the filaments of the present invention include $C_9$-$C_{15}$ alkyl benzene sulfonates (LAS), $C_8$-$C_{20}$ alkyl ether sulfates, for example alkyl poly(ethoxy) sulfates, $C_8$-$C_{20}$ alkyl sulfates, and mixtures thereof. Other anionic surfactants include methyl ester sulfonates (MES), secondary alkane sulfonates, methyl ester ethoxylates (MEE), sulfonated estolides, and mixtures thereof.

In another example, the anionic surfactant is selected from the group consisting of: $C_{11}$-$C_{18}$ alkyl benzene sulfonates ("LAS") and primary, branched-chain and random $C_{10}$-$C_{20}$ alkyl sulfates ("AS"), $C_{10}$-$C_{18}$ secondary (2,3) alkyl sulfates of the formula $CH_3(CH_2)_x(CHOSO_3^-M^+)$ $CH_3$ and $CH_3(CH_2)_y(CHOSO_3^-\ M^+)$ $CH_2CH_3$ where x and (y+1) are integers of at least about 7 and/or at least about 9, and M is a water-solubilizing cation, especially sodium, unsaturated sulfates such as oleyl sulfate, the $C_{10}$-$C_{18}$ alpha-sulfonated fatty acid esters, the $C_{10}$-$C_{18}$ sulfated alkyl polyglycosides, the $C_{10}$-$C_{18}$ alkyl alkoxy sulfates ("$AE_xS$") wherein x is from 1-30, and $C_{10}$-$C_{18}$ alkyl alkoxy carboxylates, for example comprising 1-5 ethoxy units, mid-chain branched alkyl sulfates as discussed in U.S. Pat. Nos. 6,020,303 and 6,060,443; mid-chain branched alkyl alkoxy sulfates as discussed in U.S. Pat. Nos. 6,008,181 and 6,020,303; modified alkylbenzene sulfonate (MLAS) as discussed in WO 99/05243, WO 99/05242 and WO 99/05244; methyl ester sulfonate (MES); and alpha-olefin sulfonate (AOS).

Other suitable anionic surfactants that may be used are alkyl ester sulfonate surfactants including sulfonated linear esters of $C_8$-$C_{20}$ carboxylic acids (i.e., fatty acids). Other suitable anionic surfactants that may be used include salts of soap, $C_8$-$C_{22}$ primary of secondary alkanesulfonates, $C_8$-$C_{24}$ olefinsulfonates, sulfonated polycarboxylic acids, $C_8$-$C_{24}$ alkylpolyglycolethersulfates (containing up to 10 moles of ethylene oxide); alkyl glycerol sulfonates, fatty acyl glycerol sulfonates, fatty oleoyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (for example saturated and unsaturated $C_{12}$-$C_{18}$ monoesters) and diesters of sulfosuccinates (for example saturated and unsaturated $C_6$-$C_{12}$ diesters), sulfates of alkylpolysaccharides such as the sulfates of alkylpolyglucoside, and alkyl polyethoxy carboxylates such as those of the formula $RO(CH_2CH_2O)_k$—$CH_2COO$-M+ wherein R is a $C_8$-$C_{22}$ alkyl, k is an integer from 0 to 10, and M is a soluble salt-forming cation.

Other exemplary anionic surfactants are the alkali metal salts of $C_{10}$-$C_{16}$ alkyl benzene sulfonic acids, such as $C_{11}$-$C_{14}$ alkyl benzene sulfonic acids. In one example, the alkyl group is linear. Such linear alkyl benzene sulfonates are known as "LAS". Such surfactants and their preparation are described for example in U.S. Pat. Nos. 2,220,099 and 2,477,383. In another example, the linear alkyl benzene sulfonates include the sodium and/or potassium linear straight chain alkylbenzene sulfonates in which the average number of carbon atoms in the alkyl group is from about 11 to 14. Sodium $C_{11}$-$C_{14}$ LAS, e.g., $C_{12}$ LAS, is a specific example of such surfactants.

Another exemplary type of anionic surfactant comprises linear or branched ethoxylated alkyl sulfate surfactants. Such materials, also known as alkyl ether sulfates or alkyl polyethoxylate sulfates, are those which correspond to the formula: R'—O—$(C_2H_4O)_n$—$SO_3M$ wherein R' is a $C_8$-$C_{20}$ alkyl group, n is from about 1 to 20, and M is a salt-forming cation. In a specific embodiment, R' is $C_{10}$-$C_{18}$ alkyl, n is from about 1 to 15, and M is sodium, potassium, ammonium, alkylammonium, or alkanolammonium. In more specific embodiments, R' is a $C_{12}$-$C_{16}$, n is from about 1 to 6 and M is sodium. The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions of this invention and used as or in any anionic surfactant component which may be present. Specific examples of non-alkoyxylated, e.g., non-ethoxylated, alkyl ether sulfate surfactants are those produced by the sulfation of higher $C_8$-$C_{20}$ fatty alcohols. Conventional primary alkyl sulfate surfactants have the general formula: $R''OSO_3^-M^+$ wherein R" is typically a $C_8$-$C_{20}$ alkyl group, which may be straight chain or branched chain, and M is a water-solubilizing cation. In specific embodiments, R" is a $C_{10}$-$C_{15}$ alkyl group, and M is alkali metal, more specifically R" is $C_{12}$-$C_{14}$ alkyl and M is sodium. Specific, non-limiting examples of anionic surfactants useful herein include: a) $C_{11}$-$C_{18}$ alkyl benzene sulfonates (LAS); b) $C_{10}$-$C_{20}$ primary, branched-chain and random alkyl sulfates (AS); c) $C_{10}$-$C_{18}$ secondary (2,3)-alkyl sulfates having following formulae:

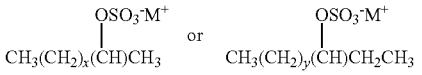

wherein M is hydrogen or a cation which provides charge neutrality, and all M units, whether associated with a surfactant or adjunct ingredient, can either be a hydrogen atom or a cation depending upon the form isolated by the artisan or the relative pH of the system wherein the compound is used, with non-limiting examples of suitable cations including sodium, potassium, ammonium, and mixtures thereof, and x is an integer of at least 7 and/or at least about 9, and y is an integer of at least 8 and/or at least 9; d) $C_{10}$-$C_{18}$ alkyl alkoxy sulfates ($AE_zS$) wherein z, for example, is from 1-30; e) $C_{10}$-$C_{18}$ alkyl alkoxy carboxylates such as those comprising 1-5 ethoxy units; f) mid-chain branched alkyl sulfates as discussed in U.S. Pat. Nos. 6,020,303 and 6,060,443; g) mid-chain branched alkyl alkoxy sulfates as discussed in U.S. Pat. Nos. 6,008,181 and 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

b. Cationic Surfactants

Non-limiting examples of suitable cationic surfactants include, but are not limited to, those having the formula (I):

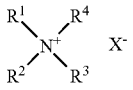

I in which $R^1$, $R^2$, $R^3$, and $R^4$ are each independently selected from (a) an aliphatic group of from 1 to 26 carbon atoms, or (b) an aromatic, alkoxy, polyoxyalkylene, alkylamido, hydroxyalkyl, aryl or alkylaryl group having up to 22 carbon atoms; and X is a salt-forming anion such as those selected from halogen, (e.g. chloride, bromide), acetate, citrate, lactate, glycolate, phosphate, nitrate, sulphate, and alkylsulphate radicals. In one example, the alkylsulphate radical is methosulfate and/or ethosulfate.

Suitable quaternary ammonium cationic surfactants of general formula (I) may include cetyltrimethylammonium chloride, behenyltrimethylammonium chloride (BTAC), stearyltrimethylammonium chloride, cetylpyridinium chloride, octadecyltrimethylammonium chloride, hexadecyltrimethylammonium chloride, octyldimethylbenzylammonium chloride, decyldimethylbenzylammonium chloride, stearyldimethylbenzylammonium chloride, didodecyldimethylammonium chloride, didecyldimehtylammonium chloride, dioctadecyldimethylammonium chloride, distearyldimethylammonium chloride, tallowtrimethylammonium chloride, cocotrimethylammonium chloride, 2-ethylhexylstearyldimethylammonum chloride, dipalmitoylethyldimethylammonium chloride, PEG-2 oleylammonium chloride and salts of these, where the chloride is replaced by halogen, (e.g., bromide), acetate, citrate, lactate, glycolate, phosphate nitrate, sulphate, or alkylsulphate.

Non-limiting examples of suitable cationic surfactants are commercially available under the trade names ARQUAD® from Akzo Nobel Surfactants (Chicago, Ill.).

In one example, suitable cationic surfactants include quaternary ammonium surfactants, for example that have up to 26 carbon atoms include: alkoxylate quaternary ammonium (AQA) surfactants as discussed in U.S. Pat. No. 6,136,769; dimethyl hydroxyethyl quaternary ammonium as discussed in 6,004,922; dimethyl hydroxyethyl lauryl ammonium chloride; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660 4,260,529 and U.S. Pat. No. 6,022,844; and amino surfactants as discussed in U.S. Pat. No. 6,221,825 and WO 00/47708, for example amido propyldimethyl amine (APA).

Other suitable cationic surfactants include salts of primary, secondary, and tertiary fatty amines. In one embodiment, the alkyl groups of such amines have from about 12 to about 22 carbon atoms, and can be substituted or unsubstituted. These amines are typically used in combination with an acid to provide the cationic species.

The cationic surfactant may include cationic ester surfactants having the formula:

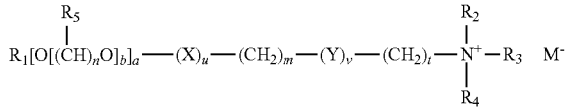

wherein $R_1$ is a $C_5$-$C_{31}$ linear or branched alkyl, alkenyl or alkaryl chain or $M^-.N^-(R_6R_7R_8)(CH_2)_S$; X and Y, independently, are selected from the group consisting of COO, OCO, O, CO, OCOO, CONH, NHCO, OCONH and NHCOO wherein at least one of X or Y is a COO, OCO, OCOO, OCONH or NHCOO group; $R_2$, $R_3$, $R_4$, $R_6$, $R_7$ and $R_8$ are independently selected from the group consisting of alkyl, alkenyl, hydroxyalkyl, hydroxyalkenyl and alkaryl groups having from 1 to 4 carbon atoms; and $R_5$ is independently H or a $C_1$-$C_3$ alkyl group; wherein the values of m, n, s and t independently lie in the range of from 0 to 8, the value of b lies in the range from 0 to 20, and the values of a, u and v independently are either 0 or 1 with the proviso that at least one of u or v must be 1; and wherein M is a counter anion. In one example, $R_2$, $R_3$ and $R_4$ are independently selected from $CH_3$ and —$CH_2CH_2OH$. In another example, M is selected from the group consisting of halide, methyl sulfate, sulfate, nitrate, chloride, bromide, or iodide.

The cationic surfactants of the present invention may be chosen for use in personal cleansing applications. In one example, such cationic surfactants may be included in the filament and/or fiber at a total level by weight of from about 0.1% to about 10% and/or from about 0.5% to about 8% and/or from about 1% to about 5% and/or from about 1.4% to about 4%, in view of balance among ease-to-rinse feel, rheology and wet conditioning benefits. A variety of cationic surfactants including mono- and di-alkyl chain cationic surfactants can be used in the compositions of the present invention. In one example, the cationic surfactants include mono-alkyl chain cationic surfactants in view of providing desired gel matrix and wet conditioning benefits. The mono-alkyl cationic surfactants are those having one long alkyl chain which has from 12 to 22 carbon atoms and/or from 16 to 22 carbon atoms and/or from 18 to 22 carbon atoms in its alkyl group, in view of providing balanced wet conditioning benefits. The remaining groups attached to nitrogen are independently selected from an alkyl group of from 1 to about 4 carbon atoms or an alkoxy, polyoxyalkylene, alkylamido, hydroxyalkyl, aryl or alkylaryl group having up to about 4 carbon atoms. Such mono-alkyl cationic surfactants include, for example, mono-alkyl quaternary ammonium salts and mono-alkyl amines Mono-alkyl quaternary ammonium salts include, for example, those having a non-functionalized long alkyl chain. Mono-alkyl amines include, for example, mono-alkyl amidoamines and salts thereof. Other cationic surfactants such as di-alkyl chain cationic surfactants may also be used alone, or in combination with the mono-alkyl chain cationic surfactants. Such di-alkyl chain cationic surfactants include, for example, dialkyl (14-18) dimethyl ammonium chloride, ditallow alkyl dimethyl ammonium chloride, dihydrogenated tallow alkyl dimethyl ammonium chloride, distearyl dimethyl ammonium chloride, and dicetyl dimethyl ammonium chloride.

In one example the cationic ester surfactants are hydrolyzable under the conditions of a laundry wash.

c. Nonionic Surfactants

Non-limiting examples of suitable nonionic surfactants include alkoxylated alcohols (AE's) and alkyl phenols, polyhydroxy fatty acid amides (PFAA's), alkyl polyglycosides (APG's), $C_{10}$-$C_{18}$ glycerol ethers, and the like.

In one example, non-limiting examples of nonionic surfactants useful in the present invention include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block alkyl polyamine ethoxylates such as PLURONIC® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1-30, as discussed in U.S. Pat. Nos. 6,153,577, 6,020,303 and 6,093,856; alkylpolysaccharides as discussed in U.S. Pat. No. 4,565,647 Llenado, issued Jan. 26, 1986; specifically alkylpolyglycosides as discussed in U.S. Pat. Nos. 4,483,780 and 4,483,779; polyhydroxy detergent acid amides as discussed in U.S. Pat. No. 5,332,528; and ether capped poly(oxyalkylated) alcohol surfactants as discussed in U.S. Pat. No. 6,482,994 and WO 01/42408.

Examples of commercially available nonionic surfactants suitable for the present invention include: Tergitol® 15-S-9 (the condensation product of $C_{11}$-$C_{15}$ linear alcohol with 9 moles ethylene oxide) and Tergitol® 24-L-6 NMW (the condensation product of $C_{12}$-$C_{14}$ primary alcohol with 6 moles ethylene oxide with a narrow molecular weight distribution), both marketed by Dow Chemical Company; Neodol® 45-9 (the condensation product of $C_{14}$-$C_{15}$ linear alcohol with 9 moles of ethylene oxide), Neodol® 23-3 (the condensation product of $C_{12}$-$C_{13}$ linear alcohol with 3 moles of ethylene oxide), Neodol® 45-7 (the condensation product of $C_{14}$-$C_{15}$ linear alcohol with 7 moles of ethylene oxide) and Neodol® 45-5 (the condensation product of $C_{14}$-$C_{15}$ linear alcohol with 5 moles of ethylene oxide) marketed by Shell Chemical Company; Kyro® EOB (the condensation product of $C_{13}$-$C_{15}$ alcohol with 9 moles ethylene oxide), marketed by The Procter & Gamble Company; and Genapol LA 030 or 050 (the condensation product of $C_{12}$-$C_{14}$ alcohol with 3 or 5 moles of ethylene oxide) marketed by Hoechst. The nonionic surfactants may exhibit an HLB range of from about 8 to about 17 and/or from about 8 to about 14. Condensates with propylene oxide and/or butylene oxides may also be used.

Non-limiting examples of semi-polar nonionic surfactants useful in the present invention include: water-soluble amine oxides containing one alkyl moiety of from about 10 to about 18 carbon atoms and 2 moieties selected from the group consisting of alkyl moieties and hydroxyalkyl moieties containing from about 1 to about 3 carbon atoms; water-soluble phosphine oxides containing one alkyl moiety of from about 10 to about 18 carbon atoms and 2 moieties selected from the group consisting of alkyl moieties and hydroxyalkyl moieties containing from about 1 to about 3 carbon atoms; and water-soluble sulfoxides containing one alkyl moiety of from about 10 to about 18 carbon atoms and a moiety selected from the group consisting of alkyl moieties and hydroxyalkyl moieties of from about 1 to about 3 carbon atoms. See WO 01/32816, U.S. Pat. Nos. 4,681,704, and 4,133,779.

Another class of nonionic surfactants that may be used in the present invention includes polyhydroxy fatty acid amide surfactants of the following formula:

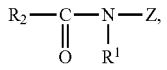

wherein $R^1$ is H, or $C_{1-4}$ hydrocarbyl, 2-hydroxy ethyl, 2-hydroxy propyl or a mixture thereof, $R_2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. In one example, $R^1$ is methyl, $R_2$ is a straight $C_{11-15}$ alkyl or $C_{15-17}$ alkyl or alkenyl chain such as coconut alkyl or mixtures thereof, and Z is derived from a reducing sugar such as glucose, fructose, maltose, lactose, in a reductive amination reaction. Typical examples include the $C_{12}$-$C_{18}$ and $C_{12}$-$C_{14}$ N-methylglucamides.

Alkylpolyaccharide surfactants may also be used as a nonionic surfactant in the present invention.

Polyethylene, polypropylene, and polybutylene oxide condensates of alkyl phenols are also suitable for use as a nonionic surfactant in the present invention. These compounds include the condensation products of alkyl phenols having an alkyl group containing from about 6 to about 14 carbon atoms, in either a straight-chain or branched-chain configuration with the alkylene oxide. Commercially available nonionic surfactants of this type include Igepal® CO-630, marketed by the GAF Corporation; and Triton® X-45, X-114, X-100 and X-102, all marketed by the Dow Chemical Company.

For automatic dishwashing applications, low foaming nonionic surfactants may be used. Suitable low foaming nonionic surfactants are disclosed in U.S. Pat. No. 7,271,138 col. 7, line 10 to col. 7, line 60.

Examples of other suitable nonionic surfactants are the commercially-available Pluronic® surfactants, marketed by BASF, the commercially available Tetronic® compounds, marketed by BASF, and the commercially available Plurafac® surfactants, marketed by BASF.

d. Zwitterionic Surfactants

Non-limiting examples of zwitterionic or ampholytic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides and sulfo and hydroxy betaines, such as N-alkyl-N,N-dimethylammino-1-propane sulfonate where the alkyl group can be $C_8$ to $C_{18}$ and in certain embodiments from $C_{10}$ to $C_{14}$.

e. Amphoteric Surfactants

Non-limiting examples of amphoteric surfactants include: aliphatic derivatives of secondary or tertiary amines, or aliphatic derivatives of heterocyclic secondary and tertiary amines in which the aliphatic radical can be straight- or branched-chain and mixtures thereof. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of amphoteric surfactants.

f. Co-Surfactants

In addition to the surfactants described above, the filaments may also contain co-surfactants. In the case of laundry detergents and/or dishwashing detergents, they typically contain a mixture of surfactant types in order to obtain broad-scale cleaning performance over a variety of soils and stains and under a variety of usage conditions. A wide range of these co-surfactants can be used in the filaments of the present invention. A typical listing of anionic, nonionic, ampholytic and zwitterionic classes, and species of these co-surfactants, is given herein above, and may also be found in U.S. Pat. No. 3,664,961. In other words, the surfactant systems herein may also include one or more co-surfactants selected from nonionic, cationic, anionic, zwitterionic or mixtures thereof. The selection of co-surfactant may be dependent upon the desired benefit. The surfactant system may comprise from 0% to about 10%, or from about 0.1% to about 5%, or from about 1% to about 4% by weight of the composition of other co-surfactant(s).

g. Amine-Neutralized Anionic Surfactants

The anionic surfactants and/or anionic co-surfactants of the present invention may exist in an acid form, which may be neutralized to form a surfactant salt. In one example, the filaments may comprise a surfactant salt form. Typical agents for neutralization include a metal counterion base such as hydroxides, eg, NaOH or KOH. Other agents for neutralizing the anionic surfactants and anionic co-surfactants in their acid forms include ammonia, amines, or alkanolamines. In one example, the neutralizing agent comprises an alkanolamine, for example an alkanolamine selected from the group consisting of: monoethanolamine, diethanolamine, triethanolamine, and other linear or branched alkanolamines known in the art; for example, 2-amino-1-propanol, 1-aminopropanol, monoisopropanolamine, or 1-amino-3-propanol. Amine neutralization may be done to a full or partial extent, e.g. part of the anionic surfactant mix may be neutralized with sodium or potassium and part of the anionic surfactant mix may be neutralized with amines or alkanolamines Softening Agents One or more softening agents may be present in the fibrous elements. Non-limiting examples of suitable softening agents include quaternary ammonium compounds for example a quaternary ammonium esterquat compound, silicones such as polysiloxanes, clays such as smectite clays, and mixture thereof.

In one example, the softening agents comprise a fabric softening agent. Non-limiting examples of fabric softening agents include impalpable smectite clays, such as those described in U.S. Pat. No. 4,062,647, as well as other fabric softening clays known in the art. When present, the fabric softening agent may be present in the filaments at a level from about 0.5% to about 10% and/or from about 0.5% to about 5% by weight on a dry filament basis and/or dry detergent product basis. Fabric softening clays may be used in combination with amine and/or cationic softening agents such as those disclosed in U.S. Pat. Nos. 4,375,416, and 4,291,071. Cationic softening agents may also be used without fabric softening clays.

Conditioning Agents

The fibrous elements of the present invention may include one or more conditioning agents, such as a high melting point fatty compound. The high melting point fatty compound may have a melting point of about 25° C. or greater, and may be selected from the group consisting of: fatty alcohols, fatty acids, fatty alcohol derivatives, fatty acid derivatives, and mixtures thereof. Such fatty compounds that exhibit a low melting point (less than 25° C.) are not intended to be included as a conditioning agent. Non-limiting examples of the high melting point fatty compounds are found in International Cosmetic Ingredient Dictionary, Fifth Edition, 1993, and CTFA Cosmetic Ingredient Handbook, Second Edition, 1992.

One or more high melting point fatty compounds may be included in the filaments of the present invention at a level from about 0.1% to about 40% and/or from about 1% to about 30% and/or from about 1.5% to about 16% and/or from about 1.5% to about 8% by weight on a dry fibrous element basis and/or dry fibrous structure basis. The conditioning agents may provide conditioning benefits, such as slippery feel during the application to wet hair and/or fabrics, softness and/or moisturized feel on dry hair and/or fabrics.

The fibrous elements of the present invention may contain a cationic polymer as a conditioning agent. Concentrations of the cationic polymer in the fibrous elements, when present, typically range from about 0.05% to about 3% and/or from about 0.075% to about 2.0% and/or from about 0.1% to about 1.0% by weight on a dry fibrous element basis and/or dry fibrous structure basis. Non-limiting examples of suitable cationic polymers may have cationic charge densities of at least 0.5 meq/gm and/or at least 0.9 meq/gm and/or at least 1.2 meq/gm and/or at least 1.5 meq/gm at a pH of from about 3 to about 9 and/or from about 4 to about 8. In one example, cationic polymers suitable as conditioning agents may have cationic charge densities of less than 7 meq/gm and/or less than 5 meq/gm at a pH of from about 3 to about 9 and/or from about 4 to about 8. Herein, "cationic charge density" of a polymer refers to the ratio of the number of positive charges on the polymer to the molecular weight of the polymer. The weight average molecular weight of such suitable cationic polymers will generally be between about 10,000 and 10 million, in one embodiment between about 50,000 and about 5 million, and in another embodiment between about 100,000 and about 3 million.

Suitable cationic polymers for use in the fibrous elements of the present invention may contain cationic nitrogen-containing moieties such as quaternary ammonium and/or cationic protonated amino moieties. Any anionic counterions may be used in association with the cationic polymers so long as the cationic polymers remain soluble in water and so long as the counterions are physically and chemically compatible with the other components of the fibrous elements or do not otherwise unduly impair product performance, stability or aesthetics of the filaments. Non-limiting examples of such counterions include halides (e.g., chloride, fluoride, bromide, iodide), sulfates and methylsulfates.

Non-limiting examples of such cationic polymers are described in the CTFA Cosmetic Ingredient Dictionary, 3rd edition, edited by Estrin, Crosley, and Haynes, (The Cosmetic, Toiletry, and Fragrance Association, Inc., Washington, D.C. (1982)).

Other suitable cationic polymers for use in the fibrous elements of the present invention include cationic polysaccharide polymers, cationic guar gum derivatives, quaternary nitrogen-containing cellulose ethers, cationic synthetic polymers, cationic copolymers of etherified cellulose, guar and starch. When used, the cationic polymers herein are soluble in water. Further, suitable cationic polymers for use in the fibrous elements of the present invention are described in U.S. Pat. Nos. 3,962,418, 3,958,581, and U.S. 2007/0207109A1, which are all incorporated herein by reference.

The fibrous elements of the present invention may include a nonionic polymer as a conditioning agent. Polyalkylene glycols having a molecular weight of more than about 1000 are useful herein. Useful are those having the following general formula:

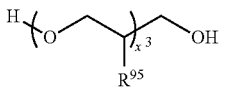

wherein $R^{95}$ is selected from the group consisting of: H, methyl, and mixtures thereof.

Silicones may be included in the fibrous elements as conditioning agents. The silicones useful as conditioning agents typically comprise a water insoluble, water dispersible, non-volatile, liquid that forms emulsified, liquid particles. Suitable conditioning agents for use in the composition are those conditioning agents characterized generally as silicones (e.g., silicone oils, cationic silicones, silicone gums, high refractive silicones, and silicone resins), organic conditioning oils (e.g., hydrocarbon oils, polyolefins, and fatty esters) or combinations thereof, or those conditioning agents which otherwise form liquid, dispersed particles in the aqueous surfactant matrix herein. Such conditioning agents should be physically and chemically compatible with the essential components of the composition, and should not otherwise unduly impair product stability, aesthetics or performance.

The concentration of the conditioning agents in the fibrous elements may be sufficient to provide the desired conditioning benefits. Such concentration can vary with the conditioning agent, the conditioning performance desired, the average size of the conditioning agent particles, the type and concentration of other components, and other like factors.

The concentration of the silicone conditioning agents typically ranges from about 0.01% to about 10% by weight on a dry fibrous element basis and/or dry fibrous structure basis. Non-limiting examples of suitable silicone conditioning agents, and optional suspending agents for the silicone, are described in U.S. Reissue Pat. No. 34,584, U.S. Pat. Nos. 5,104,646; 5,106,609; 4,152,416; 2,826,551; 3,964,500; 4,364,837; 6,607,717; 6,482,969; 5,807,956; 5,981,681; 6,207,782; 7,465,439; 7,041,767; 7,217,777; US Patent Application Nos. 2007/0286837A1; 2005/0048549A1; 2007/0041929A1; British Pat. No. 849,433; German Patent No. DE 10036533, which are all incorporated herein by reference; Chemistry and Technology of Silicones, New York: Academic Press (1968); General Electric Silicone Rubber Product Data Sheets SE 30, SE 33, SE 54 and SE 76; Silicon Compounds, Petrarch Systems, Inc. (1984); and in Encyclopedia of Polymer Science and Engineering, vol. 15, 2d ed., pp 204-308, John Wiley & Sons, Inc. (1989).

In one example, the fibrous elements of the present invention may also comprise from about 0.05% to about 3% by weight on a dry fibrous element basis and/or dry fibrous structure basis of at least one organic conditioning oil as a conditioning agent, either alone or in combination with other conditioning agents, such as the silicones (described herein). Suitable conditioning oils include hydrocarbon oils, polyolefins, and fatty esters. Also suitable for use in the compositions herein are the conditioning agents described by the Procter & Gamble Company in U.S. Pat. Nos. 5,674,478, and 5,750,122. Also suitable for use herein are those conditioning agents described in U.S. Pat. Nos. 4,529,586, 4,507,280, 4,663,158, 4,197,865, 4,217, 914, 4,381,919, and 4,422, 853, which are all incorporated herein by reference.

Release of Active Agent

One or more active agents may be released from the fibrous element and/or particle and/or fibrous structure when the fibrous element and/or particle and/or fibrous structure is exposed to a triggering condition. In one example, one or more active agents may be released from the fibrous element and/or particle and/or fibrous structure or a part thereof when the fibrous element and/or particle and/or fibrous structure or the part thereof loses its identity, in other words, loses its physical structure. For example, a fibrous element and/or particle and/or fibrous structure loses its physical structure when the fibrous element-forming material dissolves, melts or undergoes some other transformative step such that its structure is lost. In one example, the one or more active agents are released from the fibrous element and/or particle and/or fibrous structure when the fibrous element's and/or particle's and/or fibrous structure's morphology changes.

In another example, one or more active agents may be released from the fibrous element and/or particle and/or fibrous structure or a part thereof when the fibrous element and/or particle and/or fibrous structure or the part thereof alters its identity, in other words, alters its physical structure rather than loses its physical structure. For example, a fibrous element and/or particle and/or fibrous structure alters its physical structure when the fibrous element-forming material swells, shrinks, lengthens, and/or shortens, but retains its fibrous element-forming properties.

In another example, one or more active agents may be released from the fibrous element and/or particle and/or fibrous structure with its morphology not changing (not losing or altering its physical structure).

In one example, the fibrous element and/or particle and/or fibrous structure may release an active agent upon the fibrous element and/or particle and/or fibrous structure being exposed to a triggering condition that results in the release of the active agent, such as by causing the fibrous element and/or particle and/or fibrous structure to lose or alter its identity as discussed above. Non-limiting examples of triggering conditions include exposing the fibrous element and/or particle and/or fibrous structure to solvent, a polar solvent, such as alcohol and/or water, and/or a non-polar solvent, which may be sequential, depending upon whether the fibrous element-forming material comprises a polar solvent-soluble material and/or a non-polar solvent-soluble material; exposing the fibrous element and/or particle and/or fibrous structure to heat, such as to a temperature of greater than 75° F. and/or greater than 100° F. and/or greater than 150° F. and/or greater than 200° F. and/or greater than 212° F.; exposing the fibrous element and/or particle and/or fibrous structure to cold, such as to a temperature of less than 40° F. and/or less than 32° F. and/or less than 0° F.; exposing the fibrous element and/or particle and/or fibrous structure to a force, such as a stretching force applied by a consumer using the fibrous element and/or particle and/or fibrous structure; and/or exposing the fibrous element and/or particle and/or fibrous structure to a chemical reaction; exposing the fibrous element and/or particle and/or fibrous structure to a condition that results in a phase change; exposing the fibrous element and/or particle and/or fibrous structure to a pH change and/or a pressure change and/or temperature change; exposing the fibrous element and/or particle and/or fibrous structure to one or more chemicals that result in the fibrous element and/or particle and/or fibrous structure releasing one or more of its active agents; exposing the fibrous element and/or particle and/or fibrous structure to ultrasonics; exposing the fibrous element and/or particle and/or fibrous structure to light and/or certain wavelengths; exposing the fibrous element and/or particle and/or fibrous structure to a different ionic strength; and/or exposing the fibrous element and/or particle and/or fibrous structure to an active agent released from another fibrous element and/or particle and/or fibrous structure.

In one example, one or more active agents may be released from the fibrous elements and/or particles of the present invention when a fibrous structure comprising the fibrous elements and/or particles is subjected to a triggering step selected from the group consisting of: pre-treating stains on a fabric article with the fibrous structure; forming a wash liquor by contacting the fibrous structure with water; tumbling the fibrous structure in a dryer; heating the fibrous structure in a dryer; and combinations thereof.

Fibrous Element-Forming Composition

The fibrous elements of the present invention are made from a fibrous element-forming composition. The fibrous element-forming composition is a polar-solvent-based composition. In one example, the fibrous element-forming composition is an aqueous composition comprising one or more fibrous element-forming materials, a polyethylene oxide that exhibits a weight average molecular weight of greater than 10,000 g/mol but less than 500,000 g/mol as measured according to the Weight Average Molecular Weight Test Method described herein, and optionally, one or more active agents and/or a second polyethylene oxide that exhibits a weight average molecular weight of at least 500,000 g/mol as measured according to the Weight Average Molecular Weight Test Method described herein.

Even though the fibrous element and/or fibrous structure of the present invention are in solid form, the fibrous element-forming composition used to make the fibrous elements of the present invention may be in the form of a liquid.

The fibrous element-forming composition may be processed at a temperature of from about 20° C. to about 100° C. and/or from about 30° C. to about 90° C. and/or from about 35° C. to about 70° C. and/or from about 40° C. to about 60° C. when making fibrous elements from the fibrous element-forming composition.

In one example, the fibrous element-forming composition may comprise at least 20% and/or at least 30% and/or at least 40% and/or at least 45% and/or at least 50% to about 90% and/or to about 85% and/or to about 80% and/or to about 75% by weight of one or more fibrous element-forming materials, one or more active agents, and mixtures thereof. The fibrous element-forming composition may comprise from about 10% to about 80% by weight of a polar solvent, such as water.

In one example, non-volatile components of the fibrous element-forming composition may comprise from about 20% and/or 30% and/or 40% and/or 45% and/or 50% to about 75% and/or 80% and/or 85% and/or 90% by weight based on the total weight of the fibrous element-forming composition. The non-volatile components may be composed of fibrous element-forming materials, such as backbone polymers, active agents and combinations thereof. Volatile components of the fibrous element-forming composition will comprise the remaining percentage and range from 10% to 80% by weight based on the total weight of the fibrous element-forming composition.

In a fibrous element spinning process, the fibrous elements need to have initial stability as they leave the spinning die. Capillary Number is used to characterize this initial stability criterion. At the conditions of the die, the Capillary Number may be at least 1 and/or at least 3 and/or at least 4 and/or at least 5.

In one example, the fibrous element-forming composition exhibits a Capillary Number of from at least about 1 to about 50 and/or at least about 3 to about 50 and/or at least about 5 to about 30 such that the fibrous element-forming composition can be effectively polymer processed into a fibrous element.

"Polymer processing" as used herein means any spinning operation and/or spinning process by which a fibrous element comprising a processed fibrous element-forming material is formed from a fibrous element-forming composition. The spinning operation and/or process may include spun bonding, melt blowing, electro-spinning, rotary spinning, continuous filament producing and/or tow fiber producing operations/processes. A "processed fibrous element-forming material" as used herein means any fibrous element-forming material that has undergone a melt processing operation and a subsequent polymer processing operation resulting in a fibrous element.

The Capillary Number is a dimensionless number used to characterize the likelihood of this droplet breakup. A larger Capillary Number indicates greater fluid stability upon exiting the die. The Capillary Number is defined as follows:

$$Ca = \frac{V * \eta}{\sigma}$$

V is the fluid velocity at the die exit (units of Length per Time), $\eta$ is the fluid viscosity at the conditions of the die (units of Mass per Length*Time), $\sigma$ is the surface tension of the fluid (units of mass per Time$^2$).

When velocity, viscosity, and surface tension are expressed in a set of consistent units, the resulting Capillary Number will have no units of its own; the individual units will cancel out.

The Capillary Number is defined for the conditions at the exit of the die. The fluid velocity is the average velocity of the fluid passing through the die opening. The average velocity is defined as follows:

$$V = \frac{Vol'}{\text{Area}}$$

Vol'=volumetric flowrate (units of Length$^3$ per Time),

Area=cross-sectional area of the die exit (units of Length$^2$).

When the die opening is a circular hole, then the fluid velocity can be defined as $$V = \frac{Vol'}{\pi * R^2}$$

R is the radius of the circular hole (units of length).

The fluid viscosity will depend on the temperature and may depend of the shear rate. The definition of a shear thinning fluid includes a dependence on the shear rate. The surface tension will depend on the makeup of the fluid and the temperature of the fluid.

In one example, the fibrous element-forming composition may comprise one or more release agents and/or lubricants. Non-limiting examples of suitable release agents and/or lubricants include fatty acids, fatty acid salts, fatty alcohols, fatty esters, sulfonated fatty acid esters, fatty amine acetates and fatty amides, silicones, aminosilicones, fluoropolymers and mixtures thereof.

In one example, the fibrous element-forming composition may comprise one or more antiblocking and/or detackifying agents. Non-limiting examples of suitable antiblocking and/or detackifying agents include starches, modified starches, crosslinked polyvinylpyrrolidone, crosslinked cellulose, microcrystalline cellulose, silica, metallic oxides, calcium carbonate, talc and mica.

Active agents of the present invention may be added to the fibrous element-forming composition prior to and/or during fibrous element formation and/or may be added to the fibrous element after fibrous element formation. For example, a perfume active agent may be applied to the fibrous element and/or fibrous structure comprising the fibrous element after the fibrous element and/or fibrous structure according to the present invention are formed. In another example, an enzyme active agent may be applied to the fibrous element and/or fibrous structure comprising the fibrous element after the fibrous element and/or fibrous structure according to the present invention are formed. In still another example, one or more particles, which may not be suitable for passing through the spinning process for making the fibrous element, may be applied to the fibrous element and/or fibrous structure comprising the fibrous element after the fibrous element and/or fibrous structure according to the present invention are formed.

In one example, the fibrous element-forming composition of the present invention exhibits a Viscosity of less than about 100 Pa·s and/or less than about 80 Pa·s and/or less than about 60 Pa·s and/or less than about 40 Pa·s and/or less than about 20 Pa·s and/or less than about 10 Pa·s and/or less than about 5 Pa·s and/or less than about 2 Pa·s and/or less than about 1 Pa·s and/or greater than 0 Pa·s as measured according to the Shear Viscosity Test Method described herein.

Extensional Aids

In one example, the fibrous element comprises an extensional aid. Non-limiting examples of extensional aids can include polymers, other extensional aids, and combinations thereof.

In one example, the extensional aids have a weight-average molecular weight of at least about 50,000 Da. In another example, the weight average molecular weight of the extensional aid is from about 50,000 to about 25,000,000 and/or from about 100,000 to about 25,000,000 and/or from about 250,000 to about 25,000,000 and/or from about 500,000 to about 25,000,000, in another example from about 800,000 to about 22,000,000, in yet another example from about 1,000,000 to about 20,000,000, and in another example from about 2,000,000 to about 15,000,000. The high molecular weight extensional aids are especially suitable in some examples of the invention due to the ability to increase extensional melt viscosity and reducing melt fracture.

The extensional aid, when used in a meltblowing process, is added to the composition of the present invention in an amount effective to visibly reduce the melt fracture and capillary breakage of fibers during the spinning process such that substantially continuous fibers having relatively consistent diameter can be melt spun. Regardless of the process employed to produce fibrous elements and/or particles, the extensional aids, when used, can be present from about 0.001% to about 10%, by weight on a dry fibrous element basis and/or dry particle basis and/or dry fibrous structure basis, in one example, and in another example from about 0.005 to about 5%, by weight on a dry fibrous element basis and/or dry particle basis and/or dry fibrous structure basis, in yet another example from about 0.01 to about 1%, by weight on a dry fibrous element basis and/or dry particle basis and/or dry fibrous structure basis, and in another example from about 0.05% to about 0.5%, by weight on a dry fibrous element basis and/or dry particle basis and/or dry fibrous structure basis.

Non-limiting examples of polymers that can be used as extensional aids can include alginates, carrageenans, pectin, chitin, guar gum, xanthum gum, agar, gum arabic, karaya gum, tragacanth gum, locust bean gum, alkylcellulose, hydroxyalkylcellulose, carboxyalkylcellulose, and mixtures thereof.

Non-limiting examples of other extensional aids can include modified and unmodified polyacrylamide, polyacrylic acid, polymethacrylic acid, polyvinyl alcohol, polyvinylacetate, polyvinylpyrrolidone, polyethylene vinyl acetate, polyethyleneimine, polyamides, polyalkylene oxides including polyethylene oxide, polypropylene oxide, polyethylenepropylene oxide, and mixtures thereof.

Dissolution Aids

The fibrous elements of the present invention may incorporate dissolution aids to accelerate dissolution when the fibrous element contains more than 40% surfactant to mitigate formation of insoluble or poorly soluble surfactant aggregates that can sometimes form or when the surfactant compositions are used in cold water. Non-limiting examples of dissolution aids include sodium chloride, sodium sulfate, potassium chloride, potassium sulfate, magnesium chloride, and magnesium sulfate.

Buffer System

The fibrous elements of the present invention may be formulated such that, during use in an aqueous cleaning operation, for example washing clothes or dishes and/or washing hair, the wash water will have a pH of between about 5.0 and about 12 and/or between about 7.0 and 10.5. In the case of a dishwashing operation, the pH of the wash water typically is between about 6.8 and about 9.0. In the case of washing clothes, the pH of the was water typically is between 7 and 11. Techniques for controlling pH at recommended usage levels include the use of buffers, alkalis, acids, etc., and are well known to those skilled in the art. These include the use of sodium carbonate, citric acid or sodium citrate, monoethanol amine or other amines, boric acid or borates, and other pH-adjusting compounds well known in the art.

Fibrous elements and/or fibrous structures useful as "low pH" detergent compositions are included in the present invention and are especially suitable for the surfactant systems of the present invention and may provide in-use pH values of less than 8.5 and/or less than 8.0 and/or less than 7.0 and/or less than 7.0 and/or less than 5.5 and/or to about 5.0.

Dynamic in-wash pH profile fibrous elements are included in the present invention. Such fibrous elements may use wax-covered citric acid particles in conjunction with other pH control agents such that (i) 3 minutes after contact with water, the pH of the wash liquor is greater than 10; (ii) 10 mins after contact with water, the pH of the wash liquor is less than 9.5; (iii) 20 mins after contact with water, the pH of the wash liquor is less than 9.0; and (iv) optionally, wherein, the equilibrium pH of the wash liquor is in the range of from above 7.0 to 8.5.

Deterrent Agent

One or more fibrous elements and/or fibrous structures of the present invention may further comprise one or more deterrent agents; namely, an agent that is intended to discourage ingestion and/or consuming, for example via bitter taste and/or pungent taste and/or pungent smell, of the fibrous elements and/or fibrous structures and/or products comprising the same of the present invention and/or that cause humans and/or animals to vomit, for example via emetic agents. Non-limiting examples of suitable deterrent agents for use in and/or on and/or within one or more of the fibrous elements and/or fibrous structures and/or products made therefrom, such as pads, of the present invention include bittering agents, pungent agents, emetic agents, and mixtures thereof.

In one example the total level of deterrent agents associated with, for example present in and/or on, the fibrous elements, fibrous structures and/or products of the present invention may be at least a level that causes the desired deterrent effect and may depend on the characteristics of the specific deterrent agents, for example bitter value, but not a level that can cause undesired transfer of the deterrent agents to a human and/or animal, such as transfer to hands, eyes, skin, or other parts of a human and/or animal. In another example, an effective amount of a deterrent agent within and/or on a fibrous element and/or fibrous structure and/or product may be based on the particular deterrent agent's potency such that greater than 50% of humans experience a deterrent effect when exposed to the deterrent agent.

Non-Limiting Example of Method for Making Fibrous Elements

Figure 2:
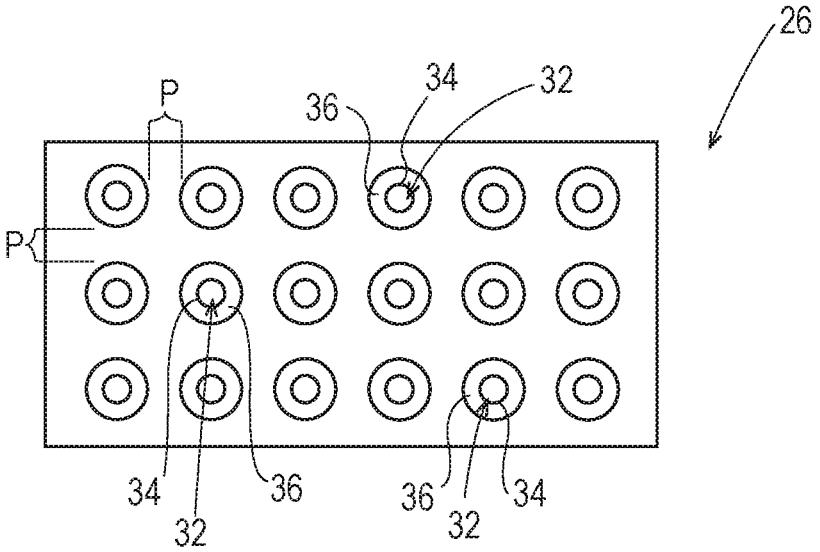
FIG. 2 is a schematic representation of an example of a die with a magnified view used in the process of FIG. 1.

The fibrous elements, for example filaments, of the present invention comprising one or more fibrous element-forming materials and a polyethylene oxide that exhibits a weight average molecular weight of greater than 10,000 g/mol but less than 500,000 g/mol as measured according to the Weight Average Molecular Weight Test Method described herein may be made as shown in FIGS. 1 and 2. As shown in FIGS. 1 and 2, a method 20 for making a fibrous element 10, for example filament, according to the present invention comprises the steps of:

a. providing a fibrous element-forming composition 22, such as from a tank 24, comprising one or more fibrous element-forming materials and a polyethylene oxide that exhibits a weight average molecular weight of greater than 10,000 g/mol but less than 500,000 g/mol as measured according to the Weight Average Molecular Weight Test Method described herein, and optionally, one or more active agents, such as a surfactant, and/or optionally, one or more polar solvents, such as water; and b. spinning the fibrous element-forming composition 22, such as via a spinning die 26, into one or more fibrous elements 10, such as filaments, comprising the one or more fibrous element-forming materials and a polyethylene oxide that exhibits a weight average molecular weight of greater than 10,000 g/mol but less than 500,000 g/mol as measured according to the Weight Average Molecular Weight Test Method described herein, and optionally, the one or more active agents.

The fibrous element-forming composition may be transported via suitable piping 28, with or without a pump 30, between the tank 24 and the spinning die 26. In one example, a pressurized tank 24, suitable for batch operation is filled with a suitable fibrous element-forming composition 22 for spinning A pump 30, such as a Zenith®, type PEP II, having a capacity of 5.0 cubic centimeters per revolution (cc/rev), manufactured by Colfax Corporation, Zenith Pumps Division, of Monroe, N.C., USA may be used to facilitate transport of the fibrous element-forming composition 22 to a spinning die 26. The flow of the fibrous element-forming composition 22 from the pressurized tank 24 to the spinning die 26 may be controlled by adjusting the number of revolutions per minute (rpm) of the pump 30. Pipes 28 are used to connect the pressurized tank 24, the pump 30, and the spinning die 26 in order to transport (as represented by the arrows) the fibrous element-forming composition 22 from the tank 24 to the pump 30 and into the die 26.

The total level of the one or more fibrous element-forming materials present in the fibrous element 10, when active agents are present therein, may be less than 80% and/or less than 70% and/or less than 65% and/or 50% or less by weight on a dry fibrous element basis and/or dry fibrous structure basis and the total level of the one or more active agents, when present in the fibrous element may be greater than 20% and/or greater than 35% and/or 50% or greater 65% or greater and/or 80% or greater by weight on a dry fibrous element basis and/or dry fibrous structure basis.

As shown in FIGS. 1 and 2, the spinning die 26 may comprise a plurality of fibrous element-forming holes 32 that include a melt capillary 34 encircled by a concentric attenuation fluid hole 36 through which a fluid, such as air, passes to facilitate attenuation of the fibrous element-forming composition 22 into a fibrous element 10 as it exits the fibrous element-forming hole 32.

In one example, the spinning die 26 shown in FIG. 2 has two or more rows of circular extrusion nozzles (fibrous element-forming holes 32) spaced from one another at a pitch P of about 1.524 millimeters (about 0.060 inches). The nozzles have individual inner diameters of about 0.305 millimeters (about 0.012 inches) and individual outside diameters of about 0.813 millimeters (about 0.032 inches). Each individual nozzle comprises a melt capillary 34 encircled by an annular and divergently flared orifice (concentric attenuation fluid hole 36) to supply attenuation air to each individual melt capillary 34. The fibrous element-forming composition 22 extruded through the nozzles is surrounded and attenuated by generally cylindrical, humidified air streams supplied through the orifices to produce fibrous elements 10.

Attenuation air can be provided by heating compressed air from a source by an electrical-resistance heater, for example, a heater manufactured by Chromalox, Division of Emerson Electric, of Pittsburgh, Pa., USA. An appropriate quantity of steam was added to saturate or nearly saturate the heated air at the conditions in the electrically heated, thermostatically controlled delivery pipe. Condensate was removed in an electrically heated, thermostatically controlled, separator.

The embryonic fibrous elements are dried by a drying air stream having a temperature from about 149° C. (about 300° F.) to about 315° C. (about 600° F.) by an electrical resistance heater (not shown) supplied through drying nozzles and discharged at an angle of about 90° relative to the general orientation of the embryonic fibrous elements being spun. The dried fibrous elements may be collected on a collection device, such as a belt or fabric, in one example a belt or fabric capable of imparting a pattern, for example a non-random repeating pattern to a fibrous structure formed as a result of collecting the fibrous elements on the belt or fabric. The addition of a vacuum source directly under the formation zone may be used to aid collection of the fibrous elements on the collection device. The spinning and collection of the fibrous elements produce a fibrous structure comprising inter-entangled fibrous elements, for example filaments.

In one example, during the spinning step, any volatile solvent, such as water, present in the fibrous element-forming composition 22 is removed, such as by drying, as the fibrous element 10 is formed. In one example, greater than 30% and/or greater than 40% and/or greater than 50% of the weight of the fibrous element-forming composition's volatile solvent, such as water, is removed during the spinning step, such as by drying the fibrous element 10 being produced.

The fibrous element-forming composition may comprise any suitable total level of fibrous element-forming materials and any suitable level of active agents so long as the fibrous element produced from the fibrous element-forming composition comprises a total level of fibrous element-forming materials in the fibrous element of from about 5% to 50% or less by weight on a dry fibrous element basis and/or dry particle basis and/or dry fibrous structure basis and a total level of active agents in the fibrous element of from 50% to about 95% by weight on a dry fibrous element basis and/or dry particle basis and/or dry fibrous structure basis.

In one example, the fibrous element-forming composition may comprise any suitable total level of fibrous element-forming materials and any suitable level of active agents so long as the fibrous element produced from the fibrous element-forming composition comprises a total level of fibrous element-forming materials in the fibrous element and/or particle of from about 5% to 50% or less by weight on a dry fibrous element basis and/or dry particle basis and/or dry fibrous structure basis and a total level of active agents in the fibrous element and/or particle of from 50% to about 95% by weight on a dry fibrous element basis and/or dry particle basis and/or dry fibrous structure basis, wherein the weight ratio of fibrous element-forming material to total level of active agents is 1 or less.

In one example, the fibrous element-forming composition comprises from about 1% and/or from about 5% and/or from about 10% to about 50% and/or to about 40% and/or to about 30% and/or to about 20% by weight of the fibrous element-forming composition of fibrous element-forming materials; from about 1% and/or from about 5% and/or from about 10% to about 50% and/or to about 40% and/or to about 30% and/or to about 20% by weight of the fibrous element-forming composition of active agents; and from about 20% and/or from about 25% and/or from about 30% and/or from about 40% and/or to about 80% and/or to about 70% and/or to about 60% and/or to about 50% by weight of the fibrous element-forming composition of a volatile solvent, such as water. The fibrous element-forming composition may comprise minor amounts of other active agents, such as less than 10% and/or less than 5% and/or less than 3% and/or less than 1% by weight of the fibrous element-forming composition of plasticizers, pH adjusting agents, and other active agents.

The fibrous element-forming composition is spun into one or more fibrous elements and/or particles by any suitable spinning process, such as meltblowing, spunbonding, electro-spinning, and/or rotary spinning. In one example, the fibrous element-forming composition is spun into a plurality of fibrous elements and/or particles by meltblowing. For example, the fibrous element-forming composition may be pumped from a tank to a meltblown spinnerette. Upon exiting one or more of the fibrous element-forming holes in the spinnerette, the fibrous element-forming composition is attenuated with air to create one or more fibrous elements and/or particles. The fibrous elements and/or particles may then be dried to remove any remaining solvent used for spinning, such as the water.

The fibrous elements and/or particles of the present invention may be collected on a belt (not shown), such as a patterned belt, for example in an inter-entangled manner such that a fibrous structure comprising the fibrous elements and/or particles is formed.

Methods of Use

In one example, the fibrous structures (which may be soluble fibrous structures) comprising one or more fabric care active agents according the present invention may be utilized in a method for treating a fabric article. The method of treating a fabric article may comprise one or more steps selected from the group consisting of: (a) pre-treating the fabric article before washing the fabric article; (b) contacting the fabric article with a wash liquor formed by contacting the fibrous structure with water; (c) contacting the fabric article with the fibrous structure in a dryer; (d) drying the fabric article in the presence of the fibrous structure in a dryer; and (e) combinations thereof.

In some embodiments, the method may further comprise the step of pre-moistening the fibrous structure prior to contacting it to the fabric article to be pre-treated. For example, the fibrous structure can be pre-moistened with water and then adhered to a portion of the fabric comprising a stain that is to be pre-treated. Alternatively, the fabric may be moistened and the fibrous structure placed on or adhered thereto. In some embodiments, the method may further comprise the step of selecting of only a portion of the fibrous structure for use in treating a fabric article. For example, if only one fabric care article is to be treated, a portion of the fibrous structure may be cut and/or torn away and either placed on or adhered to the fabric or placed into water to form a relatively small amount of wash liquor which is then used to pre-treat the fabric. In this way, the user may customize the fabric treatment method according to the task at hand. In some embodiments, at least a portion of a fibrous structure may be applied to the fabric to be treated using a device. Exemplary devices include, but are not limited to, brushes and sponges. Any one or more of the aforementioned steps may be repeated to achieve the desired fabric treatment benefit.

In another example, the fibrous structures comprising one or more hair care active agents according the present invention may be utilized in a method for treating hair. The method of treating hair may comprise one or more steps selected from the group consisting of: (a) pre-treating the hair before washing the hair; (b) contacting the hair with a wash liquor formed by contacting the fibrous structure with water; (c) post-treating the hair after washing the hair; (d) contacting the hair with a conditioning fluid formed by contacting the fibrous structure with water; and (e) combinations thereof.

NON-LIMITING EXAMPLES

Example 1

A fibrous element, for example a filament, comprising a polyethylene oxide that exhibits a weight average molecular weight greater than 10,000 g/mol but less than 500,000 g/mol; namely, that exhibits a weight average molecular weight of 100,000 g/mol (PEO 100K) as measured according to the Weight Average Molecular Weight Test Method described herein is made as follows. A fibrous element-forming composition is prepared by adding with stirring at 100-150 rpm into an appropriately sized and cleaned vessel 54% by weight distilled water. Low hydrolysis vinyl acetate-vinyl alcohol copolymer resin powders: 10% by weight of low hydrolysis vinyl acetate-vinyl alcohol copolymer resin powder (fibrous element-forming material) (Celvol PVOH 505 commercially available from Kuraray Co. Ltd. of Houston, Tex.), is weighed into a suitable container and slowly added to the water in small increments using a spatula while continuing to stir while avoiding the formation of visible lumps. Next 10% by weight of PEO 100K is added to the PVOH 505 while continuing to stir.

The mixing speed is adjusted to minimize foam formation. Then the mixture is slowly heated to 75° C. for 2 hours after which 20% by weight of a linear alkylbenzene sulfonate surfactant (active agent—anionic surfactant) and 10% by weight of an alkyl ethoxy sulfate surfactant (active agent—anionic surfactant) are added and 1% by weight of a deterrent agent described herein is then added to the mixture. The mixture is then heated to 75° C. while continuing to stir for 45 minutes and then allowed to cool to 23° C. to form a premix. This premix is then ready for spinning into fibrous elements as described herein. In one example, a plurality of the spun fibrous elements may be inter-entangled and collected on a collection device to form a fibrous structure comprising the fibrous elements.

Example 2

A fibrous element, for example a filament, comprising a polyethylene oxide that exhibits a weight average molecular weight greater than 10,000 g/mol but less than 500,000 g/mol; namely, that exhibits a weight average molecular weight of 100,000 g/mol (PEO 100K) as measured according to the Weight Average Molecular Weight Test Method described herein is made as follows. A fibrous element-forming composition is prepared by adding with stirring at 100-150 rpm into an appropriately sized and cleaned vessel 54% by weight distilled water. Low hydrolysis vinyl acetate-vinyl alcohol copolymer resin powders: 10% by weight of low hydrolysis vinyl acetate-vinyl alcohol copolymer resin powder (fibrous element-forming material) (Celvol PVOH 505 commercially available from Kuraray Co. Ltd. of Houston, Tex.), is weighed into a suitable container and slowly added to the water in small increments using a spatula while continuing to stir while avoiding the formation of visible lumps. Next 10% by weight of PEO 100K is added to the PVOH 505 while continuing to stir. Next, 5% by weight of a second polyethylene oxide that exhibits a weight average molecular weight of at least 500,000 g/mol; namely, a polyethylene oxide that exhibits a weight average molecular weight of 2,000,000 g/mol as measured according to the Weight Average Molecular Weight Test Method described herein is added to the mixture while continuing to stir.

The mixing speed is adjusted to minimize foam formation. Then the mixture is slowly heated to 75° C. for 2 hours after which 20% by weight of a linear alkylbenzene sulfonate surfactant (active agent—anionic surfactant) and 10% by weight of an alkyl ethoxy sulfate surfactant (active agent—anionic surfactant) are added and 1% by weight of a deterrent agent described herein is then added to the mixture. The mixture is then heated to 75° C. while continuing to stir for 45 minutes and then allowed to cool to 23° C. to form a premix. This premix is then ready for spinning into fibrous elements as described herein. In one example, a plurality of the spun fibrous elements may be inter-entangled and collected on a collection device to form a fibrous structure comprising the fibrous elements.

Test Methods

Unless otherwise indicated, all tests described herein including those described under the Definitions section and the following test methods are conducted on samples that have been conditioned in a conditioned room at a temperature of 23° C.±1° C. and a relative humidity of 50%±2% for 2 hours prior to the test unless otherwise indicated. Samples conditioned as described herein are considered dry samples (such as "dry fibrous elements") for purposes of this invention. Further, all tests are conducted in such conditioned room.

Water Content Test Method

The water (moisture) content present in a filament and/or fiber and/or fibrous structure is measured using the following Water Content Test Method.

A fibrous element, such as a filament, and/or fibrous structure or portion thereof ("sample") is placed in a conditioned room at a temperature of 23° C.±1° C. and a relative humidity of 50%±2% for at least 24 hours prior to testing. The weight of the sample is recorded when no further weight change is detected for at least a 5 minute period. Record this weight as the "equilibrium weight" of the sample. Next, place the sample in a drying oven for 24 hours at 70° C. with a relative humidity of about 4% to dry the sample. After the 24 hours of drying, immediately weigh the sample. Record this weight as the "dry weight" of the sample. The water (moisture) content of the sample is calculated as follows:

$$\%\ \text{Water (moisture) in sample} = 100\% \times \frac{(\text{Equilibrium weight of sample} - \text{Dry weight of sample})}{\text{Dry weight of sample}}$$

The % Water (moisture) in sample for 3 replicates is averaged to give the reported % Water (moisture) in sample.

Dissolution Test Method

Figure 5:
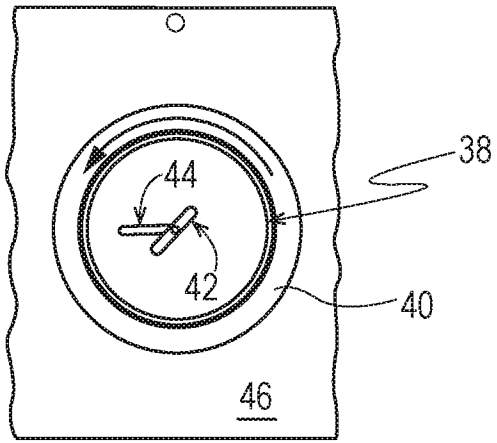
FIG. 5 is a partial top view of FIG. 3.
Figure 4:
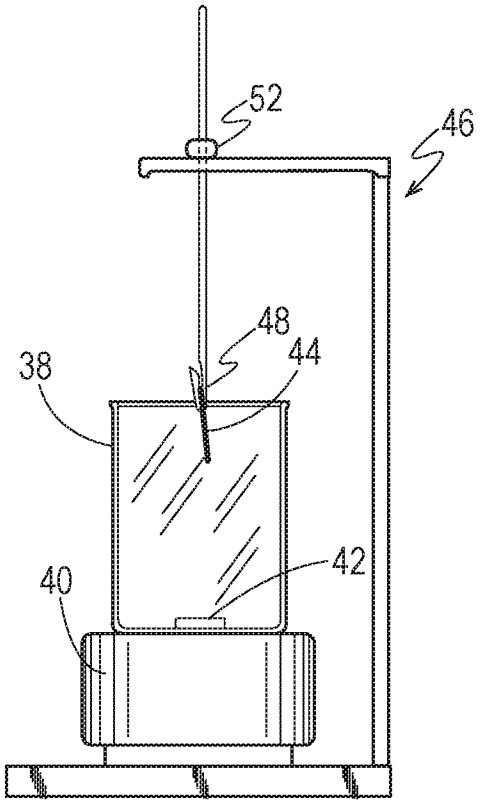
FIG. 4 is a side view of FIG. 3.

Apparatus and Materials (FIGS. 3 Through 5):

600 mL Beaker 38

Magnetic Stirrer 40 (Labline Model No. 1250 or equivalent)

Magnetic Stirring Rod 42 (5 cm)

Thermometer (1 to 100° C.+/−1° C.)

Cutting Die—Stainless Steel cutting die with dimensions 3.8 cm×3.2 cm

Timer (0-3,600 seconds or 1 hour), accurate to the nearest second. Timer used should have sufficient total time measurement range if sample exhibits dissolution time greater than 3,600 seconds. However, timer needs to be accurate to the nearest second.

Polaroid 35 mm Slide Mount 44 (commercially available from Polaroid Corporation or equivalent)

35 mm Slide Mount Holder 46 (or equivalent)

City of Cincinnati Water or equivalent having the following properties: Total Hardness=155 mg/L as $CaCO_3$; Calcium content=33.2 mg/L; Magnesium content=17.5 mg/L; Phosphate content=0.0462.

Test Protocol

Equilibrate samples in constant temperature and humidity environment of 23° C.±1° C. and 50% RH±2% for at least 2 hours.

Measure the basis weight of the sample materials using Basis Weight Method defined herein.

Cut three dissolution test specimens from fibrous structure sample using cutting die (3.8 cm×3.2 cm), so it fits within the 35 mm slide mount 44 which has an open area dimensions 24×36 mm.

Lock each specimen in a separate 35 mm slide mount 44.

Place magnetic stirring rod 42 into the 600 mL beaker 38.

Turn on the city water tap flow (or equivalent) and measure water temperature with thermometer and, if necessary, adjust the hot or cold water to maintain it at the testing temperature. Testing temperature is 15° C.±1° C. water. Once at testing temperature, fill beaker 240 with 500 mL±5 mL of the 15° C.±1° C. city water.

Place full beaker 38 on magnetic stirrer 40, turn on stirrer 40, and adjust stir speed until a vortex develops and the bottom of the vortex is at the 400 mL mark on the beaker 38.

Figure 3:
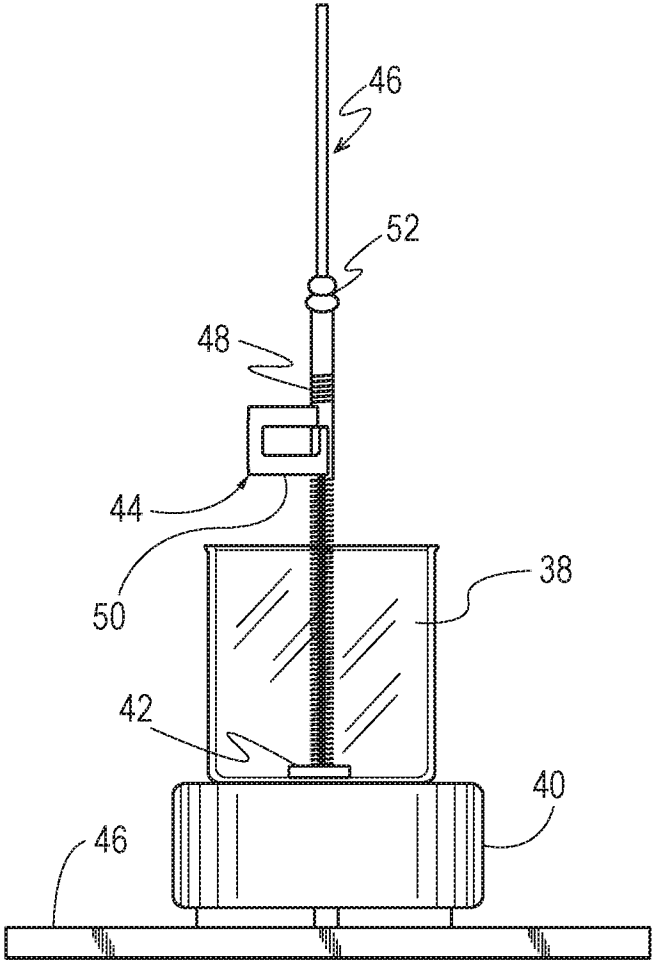
FIG. 3 is a front view of an example of a setup of equipment used in measuring dissolution according to the present invention.

Secure the 35 mm slide mount 44 in the alligator clamp 48 of the 35 mm slide mount holder 46 such that the long end 50 of the slide mount 44 is parallel to the water surface. The alligator clamp 48 should be positioned in the middle of the long end 50 of the slide mount 44. The depth adjuster 52 of the holder 46 should be set so that the distance between the bottom of the depth adjuster 52 and the bottom of the alligator clamp 48 is 11±0.125 inches. This set up will position the sample surface perpendicular to the flow of the water. A slightly modified example of an arrangement of a 35 mm slide mount and slide mount holder are shown in FIGS. 1-3 of U.S. Pat. No. 6,787,512.

In one motion, drop the secured slide and clamp into the water and start the timer. The sample is dropped so that the sample is centered in the beaker. Disintegration occurs when the fibrous structure breaks apart. Record this as the disintegration time. When all of the visible fibrous structure is released from the slide mount, raise the slide out of the water while continuing the monitor the solution for undissolved fibrous structure fragments. Dissolution occurs when all fibrous structure fragments are no longer visible. Record this as the dissolution time.

Three replicates of each sample are run and the average disintegration and dissolution times are recorded. Average disintegration and dissolution times are in units of seconds.

The average disintegration and dissolution times are normalized for basis weight by dividing each by the sample basis weight as determined by the Basis Weight Method defined herein. Basis weight normalized disintegration and dissolution times are in units of seconds/gsm of sample ($s/(g/m^2)$).

Diameter Test Method

The diameter of a discrete fibrous element or a fibrous element within a fibrous structure or film is determined by using a Scanning Electron Microscope (SEM) or an Optical Microscope and an image analysis software. A magnification of 200 to 10,000 times is chosen such that the fibrous elements are suitably enlarged for measurement. When using the SEM, the samples are sputtered with gold or a palladium compound to avoid electric charging and vibrations of the fibrous element in the electron beam. A manual procedure for determining the fibrous element diameters is used from the image (on monitor screen) taken with the SEM or the optical microscope. Using a mouse and a cursor tool, the edge of a randomly selected fibrous element is sought and then measured across its width (i.e., perpendicular to fibrous element direction at that point) to the other edge of the fibrous element. A scaled and calibrated image analysis tool provides the scaling to get actual reading in μm. For fibrous elements within a fibrous structure or film, several fibrous element are randomly selected across the sample of the fibrous structure or film using the SEM or the optical microscope. At least two portions the fibrous structure or film (or fibrous structure inside a product) are cut and tested in this manner Altogether at least 100 such measurements are made and then all data are recorded for statistical analysis. The recorded data are used to calculate average (mean) of the fibrous element diameters, standard deviation of the fibrous element diameters, and median of the fibrous element diameters.

Another useful statistic is the calculation of the amount of the population of fibrous elements that is below a certain upper limit. To determine this statistic, the software is programmed to count how many results of the fibrous element diameters are below an upper limit and that count (divided by total number of data and multiplied by 100%) is reported in percent as percent below the upper limit, such as percent below 1 micrometer diameter or %-submicron, for example. We denote the measured diameter (in μm) of an individual circular fibrous element as di.

In case the fibrous elements have non-circular cross-sections, the measurement of the fibrous element diameter is determined as and set equal to the hydraulic diameter which is four times the cross-sectional area of the fibrous element divided by the perimeter of the cross-section of the fibrous element (outer perimeter in case of hollow fibrous elements). The number-average diameter, alternatively average diameter is calculated as:

$$d_{num} = \frac{\sum_{i=1}^{n} d_i}{n}$$

Basis Weight Test Method

Basis weight of a fibrous structure sample is measured by selecting twelve (12) individual fibrous structure samples and making two stacks of six individual samples each. If the individual samples are connected to one another vie perforation lines, the perforation lines must be aligned on the same side when stacking the individual samples. A precision cutter is used to cut each stack into exactly 3.5 in.×3.5 in. squares. The two stacks of cut squares are combined to make a basis weight pad of twelve squares thick. The basis weight pad is then weighed on a top loading balance with a minimum resolution of 0.01 g. The top loading balance must be protected from air drafts and other disturbances using a draft shield. Weights are recorded when the readings on the top loading balance become constant. The Basis Weight is calculated as follows:

$$\text{Basis Weight } (\text{lbs}/3000\ \text{ft}^2) = \frac{\text{Weight of basis weight pad (g)} \times 3000\ \text{ft}^2}{453.6\ \text{g/lbs} \times 12\ \text{samples} \times [12.25\ \text{in}^2\ (\text{Area of basis weight pad})/144\ \text{in}^2]}$$

-continued $$\text{Basis Weight } (g/m^2) = \frac{\text{Weight of basis weight pad (g)} \times 10,000\ cm^2/m^2}{79.0321\ cm^2(\text{Area of basis weight pad}) \times 12\ \text{samples}}$$

If fibrous structure sample is smaller than 3.5 in.×3.5 in., then smaller sampling areas can be used for basis weight determination with associated changes to the calculations.

Weight Average Molecular Weight Test Method

The weight average molecular weight, or Mw, is measured using gel permeation chromatography (GPC) and multi-angle laser light scattering (MALLS). The GPC/MALLS system used for the analysis is comprised of a Waters Alliance 2695 Separations Module, a Waters 2414 interferometric refractometer, and a Wyatt Helios II 18 angle laser light scattering detector. The eluent is a mixture of aqueous 0.1M sodium acetate to acetonitrile 3:1 by volume. The column set used for separation is purchased from Waters Corp, Milford Mass. and included Ultrahydrogel UHG1000 (Cat #WAT011535) Ultrahydrogel UHG500 (Cat #WAT011530) and Ultrahydrogel UHG250 (Cat #WAT011525). Wyatt ASTRA 6 software was used for instrument operation and data analysis. The 90 degree light scattering detection angle is calibrated using filtered, anhydrous toluene. The remaining detection angles are normalized using an isotropic scatterer in the eluent. To verify instrument performance of the MALLS and RI (refractive index) detectors, a Pullulan standard with a known Mw and known dn/dc (in the mobile phase) is run. Acceptable performance of the MALLS and RI detectors gives a calculated Mw within 5% of the reported Mw of the Pullulan standard (200 k standard supplied by manufacture) and a mass recovery between 95 and 105%.

To complete the GPC/MALLS analysis, a value of dn/dc is needed. The value of dn/dc is measured as follows. The RI detector is thermostated to 35 degrees Celsius. A series of five concentration standards of the PEO in aqueous 0.1M sodium acetate to acetonitrile 3:1 by volume are prepared in the range 0.5 mg/ml to 5.5 mg/ml. A solvent blank is injected directly into the refractive index detector, followed by each of the PEO concentration standards, and ending with another solvent blank. The volume of each sample injected is large enough to obtain a flat plateau region of constant differential refractive index versus time; a value of 1.0 ml is typically used. In the ASTRA software, a baseline is constructed from the initial and final solvent injections. For each sample, peak limits are defined and the concentrations entered to calculate dn/dc in the ASTRA software. A typical value for dn/dc of PEO in 0.1M sodium acetate:acetonitrile (3:1 v:v) is 0.116 ml/g.

For the GPC/MALLS analysis of polyethylene oxide, the samples are dissolved in eluent (0.1 M sodium acetate to acetonitrile 3:1 by volume). Concentrations for the polyethylene oxide are approximately 2-3 mg/ml. After all the material is dissolved, each solution is filtered by a 0.45 micron nylon filter disk into a GPC autosampler vial for analysis. The GPC column temperature is at room temperature, approximately 25 degrees Celsius. The mobile phase is 0.1M sodium acetate:acetonitrile (3:1 v:v) and is delivered at a constant flow rate of 0.5 ml/min. The injection volume is 100 microliters and the run time is 90 minutes. Baselines are constructed for all signals. Peaks are defined to bracket the eluted polymer. Baselines and scattering detectors are reviewed. Light scattering detectors that give noisy baselines or deviate by more than 10% from the Zimm formalism, a linear relationship between intensity and angle, are excluded from the calculation. Weight average molecular weight is then calculated by the software.

Fibrous Element Composition Test Method

In order to prepare fibrous elements for fibrous element composition measurement, the fibrous elements must be conditioned by removing any coating compositions and/or materials present on the external surfaces of the fibrous elements that are removable. A chemical analysis of the conditioned fibrous elements is then completed to determine the compositional make-up of the fibrous elements with respect to the fibrous element-forming materials and the active agents and the level of the fibrous element-forming materials and active agents present in the fibrous elements.

The compositional make-up of the fibrous elements with respect to the fibrous element-forming material and the active agents can also be determined by completing a cross-section analysis using TOF-SIMs or SEM. Still another method for determining compositional make-up of the fibrous elements uses a fluorescent dye as a marker. In addition, as always, a manufacturer of fibrous elements should know the compositions of their fibrous elements.

Cleaning Test Method

The ability for a fibrous element and/or fibrous structure comprising a fibrous element to remove clay US Clay and/or Black Todd Clay is determined as follows.

Technical stain swatches of CW120 cotton containing US Clay and Black Todd clay were purchased from Empirical Manufacturing Co., Inc (Cincinnati). The swatches were evaluated for stain removal in a washing machine, using 7 grains per gallon water hardness (3:1 Ca:Mg) and washed at 77° F. for 12 minutes followed by a 60° F. for 2 minutes. Two of each technical stain was evaluated and averaged in each test (2 internal controls) and the test was replicated 3 times (3 external controls). In addition to the technical soiled stains 250 grams of clean fabric was also added to the wash to simulate a fabric load weight providing the mechanical energy needed during the laundering process. Any fabric coatings or residual compounds that may have built up during the manufacturing process have been removed by washing the fabric in standard AATC 1993 detergent followed by clean hot water rinses. The total amount of fibrous structure detergent and powder used in the test was 2.30 and 3.03 grams in 7.57 liters of water. Fabrics were dried with a Kenmore Drier set to normal dry conditions.

Image analysis was used to compare each stain to an unstained fabric control. Software converted images taken into standard colorimetric values and compared these to standards based on the commonly used Macbeth Colour Rendition Chart, assigning each stain a colorimetric value (Stain Level). Six replicates of each were prepared.

Stain removal from the swatches was measured as follows:

$$\text{Stain Removal Index } (SRI) = \frac{\Delta E_{initial} - \Delta E_{washed}}{\Delta E_{initial}} \times 100$$

$\Delta E_{initial}$=Stain level before washing $\Delta E_{washed}$=Stain level after washing Shear Viscosity Test Method The shear viscosity of a composition, for example a fibrous element-forming composition of the present invention is measured using a capillary rheometer, Goettfert Rheograph 6000, manufactured by Goettfert USA of Rock Hill S.C., USA. The measurements are conducted using a capillary die having a diameter D of 1.0 mm and a length L of 30 mm (i.e., L/D=30). The die is attached to the lower end of the rheometer's 20 mm barrel, which is held at a die test temperature of 75° C. A preheated to die test temperature, 60 g sample of the composition is loaded into the barrel section of the rheometer. Rid the sample of any entrapped air. Push the sample from the barrel through the capillary die at a set of chosen rates 1,000-10,000 seconds$^{-1}$. An apparent shear viscosity can be calculated with the rheometer's software from the pressure drop the sample experiences as it goes from the barrel through the capillary die and the flow rate of the sample through the capillary die. The log (apparent shear viscosity) can be plotted against log (shear rate) and the plot can be fitted by the power law, according to the formula $\eta=K\gamma^{n-1}$, wherein K is the material's viscosity constant, n is the material's thinning index and $\gamma$ is the shear rate. The reported apparent shear viscosity of the composition herein is calculated from an interpolation to a shear rate of 3,000 sec$^{-1}$ using the power law relation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fibrous structure comprising a plurality of fibrous elements and a plurality of active agent-containing particles, wherein the plurality of fibrous elements comprise one or more fibrous element-forming materials and a first polyethylene oxide, wherein the first polyethylene oxide exhibits a weight average molecular weight of greater than 10,000 g/mol but less than 500,000 g/mol as measured according to the Weight Average Molecular Weight Test Method.

2. The fibrous structure according to claim 1 wherein the plurality of fibrous elements further comprises a second polyethylene oxide that exhibits a weight average molecular weight of at least 500,000 g/mol as measured according to the Weight Average Molecular Weight Test Method.

3. The fibrous structure according to claim 2 the first polyethylene oxide and the second polyethylene oxide are present in the plurality of fibrous elements at a weight ratio of the first polyethylene oxide to the second polyethylene oxide of at least 1:2.

4. The fibrous structure according to claim 2 wherein the first polyethylene oxide and the second polyethylene oxide are present in the plurality of fibrous elements as a blend.

5. The fibrous structure according to claim 1 wherein at least one of the fibrous element-forming materials comprises a polar solvent-soluble material.

6. The fibrous structure according to claim 5 wherein the polar solvent-soluble material comprises a water-soluble material.

7. The fibrous structure according to claim 1 wherein at least one of the fibrous element-forming materials comprises a polymer.

8. The fibrous structure according to claim 7 wherein the polymer is selected from the group consisting of: pullulan, hydroxypropylmethyl cellulose, hydroxyethyl cellulose, hydroxypropyl cellulose, polyvinyl pyrrolidone, carboxymethyl cellulose, sodium alginate, xanthan gum, tragacanth gum, guar gum, acacia gum, Arabic gum, polyacrylic acid, methylmethacrylate copolymer, carboxyvinyl polymer, dextrin, pectin, chitin, levan, elsinan, collagen, gelatin, zein, gluten, soy protein, casein, polyvinyl alcohol, starch, starch derivatives, hemicellulose, hemicellulose derivatives, proteins, chitosan, chitosan derivatives, polyethylene glycol, tetramethylene ether glycol, hydroxymethyl cellulose, and mixtures thereof.

9. The fibrous structure according to claim 8 wherein the polymer comprises polyvinyl alcohol.

10. The fibrous structure according to claim 1 wherein the plurality of fibrous elements further comprises an extensional aid.

11. The fibrous structure according to claim 1 wherein the plurality of fibrous elements further comprises one or more active agents.

12. The fibrous structure according to claim 11 wherein at least one of the active agents is releasable from the plurality of fibrous elements when the plurality of fibrous elements is exposed to conditions of intended use.

13. The fibrous structure according to claim 11 wherein at least one of the active agents is present within the plurality of fibrous elements.

14. The fibrous structure according to claim 11 wherein at least one of the active agents is present on a surface of the plurality of fibrous elements.

15. The fibrous structure according to claim 11 wherein at least one of the active agents comprises a surfactant.

16. The fibrous structure according to claim 15 wherein the surfactant is selected from the group consisting of: anionic surfactants, cationic surfactants, nonionic surfactants, zwitterionic surfactants, and mixtures thereof.

17. The fibrous structure according to claim 15 wherein the surfactant comprises a linear alkylbenzene sulfonate.

18. The fibrous structure according to claim 15 wherein the surfactant comprises an alkyl sulfate.

19. The fibrous structure according to claim 15 wherein the surfactant comprises linear alkylbenzene sulfonate and alkyl sulfate.

20. The fibrous structure according to claim 11 wherein at least one of the active agents is selected from the group consisting of: skin benefit agents, medicinal agents, lotions, fabric care agents, dishwashing agents, carpet care agents, surface care agents, hair care agents, air care agents, and mixtures thereof.

21. The fibrous structure according to claim 1 wherein at least one of the active agent-containing particles comprises an active agent selected from the group consisting of: surfactants, enzymes, builders, perfumes, suds suppressors, suds boosting agents, fabric softening agents, denture cleaning agents, hair cleaning agents, hair care agents, personal health care agents, hueing agents, bleaching agents, and mixtures thereof.

22. The fibrous structure according to claim 1 wherein at least one of the active agent-containing particles comprises a surfactant.

23. The fibrous structure according to claim 22 wherein the surfactant comprises a linear alkylbenzene sulfonate.

24. The fibrous structure according to claim 22 wherein the surfactant comprises an alkyl sulfate.

25. The fibrous structure according to claim 22 wherein the surfactant comprises linear alkylbenzene sulfonate and alkyl sulfate.

* * * * *